US006004208A

United States Patent [19]

Takemoto et al.

[11] Patent Number: 6,004,208

[45] Date of Patent: Dec. 21, 1999

[54] SLOT MACHINE THAT CAN SUPERIMPOSE ON A DISPLAY SCREEN IMAGES FROM DIFFERENT STORAGE LOCATIONS

[75] Inventors: Takatoshi Takemoto; Kazunari Kawashima, both of Taito-ku; Taizo Higaki, Higashi Murayama, all of Japan

[73] Assignee: Kabushiki Kaisha Ace Denken, Tokyo, Japan

[21] Appl. No.: 09/191,282

[22] Filed: Nov. 12, 1998

Related U.S. Application Data

[63] Continuation of application No. 08/433,327, filed as application No. PCT/JP92/01425, Nov. 4, 1992, abandoned.

[51] Int. Cl.[6] ..... A63F 9/24; G07F 17/34

[52] U.S. Cl. ..... 463/20; 463/25

[58] Field of Search ..... 463/1, 11–13, 463/16, 20, 25, 26, 29, 30, 36, 40, 42; 273/138.2, 139, 143 R, 292; 364/410.1, 412.1

[56] References Cited

U.S. PATENT DOCUMENTS

| | | | |
|---|---|---|---|
| Re. 34,244 | 5/1993 | Hagiwara | 273/138 A |
| 4,517,654 | 5/1985 | Carmean | 364/521 |
| 4,712,799 | 12/1987 | Fraley | 273/138 |
| 4,837,728 | 6/1989 | Barrie et al. | 364/412 |
| 5,123,649 | 6/1992 | Tiberio | 273/143 R |
| 5,127,651 | 7/1992 | Okada | 273/143 R |
| 5,209,479 | 5/1993 | Nagao et al. | 273/143 R |
| 5,375,830 | 12/1994 | Takemoto et al. | 273/143 R |
| 5,655,965 | 8/1997 | Takemoto et al. | 463/20 |

FOREIGN PATENT DOCUMENTS

| | | | |
|---|---|---|---|
| 0 223 577 | 5/1987 | European Pat. Off. | G07F 17/34 |
| 32 29 634 A1 | 2/1984 | Germany | G07F 17/32 |
| 2-16154 | 4/1990 | Japan | A63F 9/22 |
| 4-90779 | 3/1992 | Japan | A63F 7/02 |
| 1 466 765 | 3/1977 | United Kingdom | G07F 17/34 |
| WO 92/11070 | 7/1992 | WIPO | A63F 5/04 |
| WO 94/09874 | 5/1994 | WIPO | A63F 5/04 |

*Primary Examiner*—Jessica J. Harrison
*Assistant Examiner*—Mark A. Sager
*Attorney, Agent, or Firm*—Seed and Berry LLP

[57] ABSTRACT

A slot machine comprising display means (110) having a display screen provided on a plane opposed to a player, display control means (401) for controlling the display means (110) so as to display a still condition and a game play condition for each display window, start instruction means (108) for accepting a game play start instruction and instructing the display control means to start operation, stop instruction means (109) for accepting an instruction for stopping symbol change for each display window and instructing the display control means to stop operation, and game control means (403) for controlling game progress, wherein the improvement comprises storage means (904) for storing a plurality of symbol patterns and outputting the stored data to the display means based on read address specification, and background storage means (905) for storing backgrounds to be displayed on the display means, the display control (401) means issuing an output instruction to the storage means and the background storage means. Thus, a powerful and interesting slot machine can be provided.

24 Claims, 33 Drawing Sheets

EXTERNAL VIEW A

EXTERNAL VIEW A

EXTERNAL VIEW B

HIGH-SPEED SCREEN CHANGE OF DISPLAY UNIT

DISPLAY TIMING CHART

STILL PICTURE PATTERN

FLOW CONDITION PATTERN

GAME FLOWCHART 1 (No. 1)

GAME FLOWCHART 1 (No. 1)

GAME FLOWCHART 1 (No. 1)

GAME FLOWCHART 1 (No. 1)

GAME FLOWCHART 2 (No. 2)

GAME FLOWCHART 2 (No. 2)

GAME FLOWCHART 2 (No. 2)

GAME FLOWCHART 2 (No. 2)

JOB PROCESSING ASSIGNMENT CHART

BET AND WIN DISPLAY HARDWARE (DISPLAY UNIT)

SLOT MACHINE THAT CAN SUPERIMPOSE ON A DISPLAY SCREEN IMAGES FROM DIFFERENT STORAGE LOCATIONS

CROSS-REFERENCE TO RELATED APPLICATIONS

This application is a continuation of pending U.S. patent application Ser. No. 08/433,327, filed May 4, 1995, now abandonded; which is a 371 conversion of a PCT/JP92/01425, filed Nov. 4, 1992.

TECHNICAL FIELD

This invention relates to a screen display type slot machine comprising a display unit on a game board of the slot machine.

TECHNICAL BACKGROUND

In a conventional slot machine, three rotation drums comprising various symbols rotate. When a game start command is received, the three rotation drums are rotated and when the player presses stop switch buttons in sequence, the drum rotation is stopped. A predetermined number of game play media are paid out to the player for a winning game play in response to the combination of symbols after the drum rotation stops.

Another slot machine comprises a CRT provided on its front in place of rotation drums and displays a total of nine symbols on three rows×three columns of the CRT. Further, slot machines comprising a liquid crystal display for displaying symbols are provided as described in International Publication No. WO92/11070.

These kinds of slot machines which display symbols include slot machines which display nine symbols on three rows×three columns of the display window and slot machines which display three symbols on each of the three display windows provided for each row. In the present specification, the row of the display screen is referred to as display window.

In the slot machines in the related art, the number of combinations that can be considered for winning game play combinations varies depending on the number of input game play media. For example, when one game play medium is input, the win combination can only be a combination of the same symbols completed on a horizontal row at the intermediate stage of the three drums; when two game play media are input, it is a combination of the same symbols complete on a horizontal row at any of upper, intermediate, and lower stages of the three drums; or when three game play media are input, it is a combination of predetermined symbols completed on a horizontal row at any of upper, intermediate, and lower stages of the three drums or on a diagonal row. If a player presses a bet rate button instead of inputting game play media, the number of combinations that can be considered for win combinations varies depending on the number of game play media. To show the upper, intermediate, and lower stage and diagonal arrangements, lines are drawn along the arrangements are drawn around the drums, on the front glass. In the conventional rotating drum slot machines, the lines are printed on the front glass for surface protection; when game play media are input or the bet rate button is pressed, the betting lines light up. If the symbols on the betting line match a predetermined symbol combination after the slot machine drums stops rotating, the line display is flashed on and off.

However, in such slot machines, when the symbols match a win symbol combination, it is displayed on the front glass or a front display. Thus, it is difficult to make a display change, and the game tends to lack interest.

A slot machine using a liquid crystal display comprises a liquid crystal symbol display for displaying symbols and a liquid crystal line drawing display for displaying lines, with the latter placed in front of the former. Normally, the liquid crystal line drawing display is placed in a light transmission state and symbols are displayed on the liquid crystal symbol display. To display lines, the line display portions on the liquid crystal line drawing display are energized and changed to a light shielding state.

Since the transmission factor of a liquid crystal is poor, even if symbols are displayed in the light transmission state, they are difficult to see. In addition, since two liquid crystal panels are provided for the liquid crystal symbol and line drawing displays, costs are increased and space is wasted.

DISCLOSURE OF INVENTION

It is therefore an object of the invention to provide a slot machine which can generates a powerful and interesting display.

To this end, according to the invention, there is provided a slot machine comprising display means having a display screen provided on a plane opposed to a player, display control means for controlling the display means so as to display a plurality of symbols and a still condition for controlling game progress, wherein the improvement comprises storage means for storing a plurality of symbol patterns and background storage means for storing betting lines for winning game play combinations of predetermined symbol positions of the display windows, the display control means issuing an output instruction to the storage means and the background storage means for performing the display control. In this case, the background storage means can store pixel data in a portion corresponding to the betting line as valid data, and the display control means can superpose data output from the storage means and the background storage means on each other and display the valid data read from the background storage means taking precedence over the data output from the storage means.

The screen display type slot machine further includes selection indication means for selecting a betting lines of predetermined winning game play combination of symbol positions of the display windows, and the display control means instructs the background storage means to display the betting line selected with the selection indication means.

Further, the game control means can determine whether or not the symbol combination after symbol change stops matches a predetermined symbol combination, and the background storage means can store predetermined display information representing at least one of; an event where the symbol combination matches the predetermined symbol combination; and an event where it does not match the predetermined symbol combination, as a background.

When a plurality of the betting lines exist, a plurality of the selection indication means may be provided corresponding to the betting lines.

The selection indication means may comprise selection control means for specifying which winning game play combination is to be selected among a plurality of predetermined winning symbol position combinations, and operation sections handled by a player for selecting a winning game play combination. The operation sections may be provided corresponding to the predetermined winning game play combinations.

Thus, a betting line display for winning game play combinations and a win/loss display are stored in the background storage means, whereby a predetermined display can be provided. Also, display can be easily changed simply by rewriting the background storage means. Therefore, a powerful and interesting display type slot machine can be provided.

The screen display type slot machine can further include display order storage means for defining the display order of symbol patterns to be displayed on each display window of the display means among the symbol patterns stored in the storage means and storing start addresses of the symbol patterns stored in the storage means, hold means for holding information representing the current display state on the display means for each display window, and display position storage means for storing information on read start and end positions of the storage means for symbols to be displayed on each display window of the display means among the symbol patterns stored in the storage means in relation to game progress. The display control means can comprise address generation means for referencing the display order storage means according to the information representing the current display state held in the hold means in relation to the game progress, extracting a start address of the next symbol pattern to be read based on the display order defined in the display order storage means, referencing the display position storage means for generating addresses from the display start position to the display end position based on the extracted start address for each symbol on the display screen of each display window, and giving the generated addresses to the storage means.

The display position storage means previously stores a symbol pattern read start position address of the storage means and the number of data bytes of the symbol pattern to be displayed as the information on the read start and end positions of the storage means. The address generation means comprises data counters each being provided for each display window for loading the number of data bytes of the symbol pattern to be displayed from the display position storage means and counting the number of data bytes as the storage means is read, and address counters each being provided for each display window for obtaining the read top address of the symbol pattern in accordance with the display order and the symbol pattern start address stored in the display order storage means and the symbol pattern read start position address stored in the display position storage means and outputting symbol pattern read addresses as the storage means is read. The data and address counters load the next value after the data counter counts the number of data bytes.

The display control means reads the symbol patterns by switching outputs of the address counters each provided for each display window in a time division manner.

The storage means can be made of a ROM (read-only memory). Further, the display control means may be mounted on a circuit board, and the ROM may be removably placed on the circuit board.

The screen display type slot machine further includes background picture storage means for storing background pictures for displaying backgrounds on the display screen of the display means.

The background picture storage means can be made of a VRAM (video random access memory).

Further, the screen display type slot machine can comprise a stop mode for updating the read image at the same position on the display screen at display update, an acceleration mode for moving the read image by a distance corresponding to a movement distance of a symbol position in a condition in which the display window virtually rotates, for displaying the read image at different positions on the display screen and acceleratively increasing magnitude change of the movement distance, a constant speed mode for holding the movement distance constant, and a deceleration mode for decreasing the magnitude change of the movement distance. The display position storage means can have tables for storing the information on the read start and end positions of the storage means so as to move the symbol pattern display positions on the display means, in order, each time display is updated, the tables being provided for each of the modes. The display control means can select a table of the display position storage means to be referenced conforming to selection of each of the modes.

In the configuration, even if a large number of data bytes are loaded, the ROM can be directly addressed to read display data without writing into the frame memory, so that the display screen can be updated at high speed, whereby the screen display type slot machine of the invention can provide realistic motion close to the rotation of drums of a mechanical slot machine.

BEST MODE FOR CARRYING OUT THE INVENTION

Referring now to the accompanying drawings, there are shown embodiments of the invention.

Figure 1:
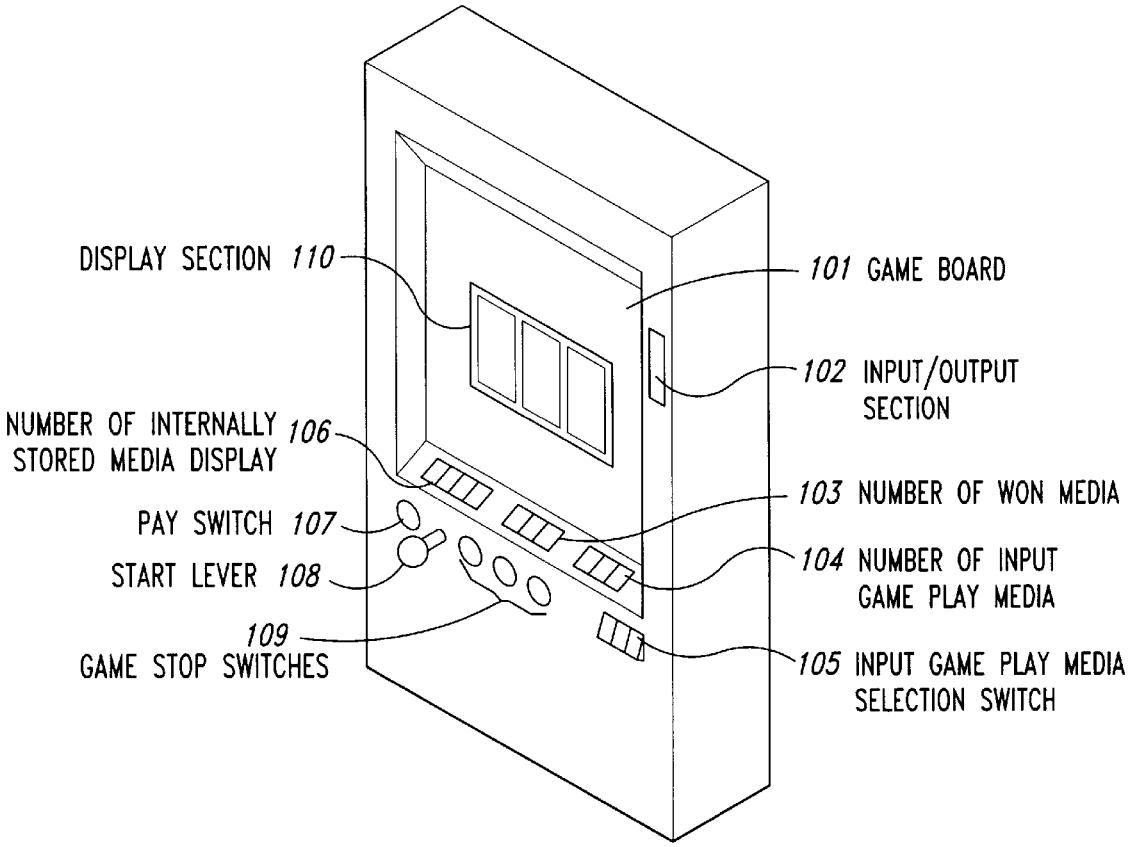
FIG. 1 is an external view A of a slot machine comprising a display unit.
Figure 2:
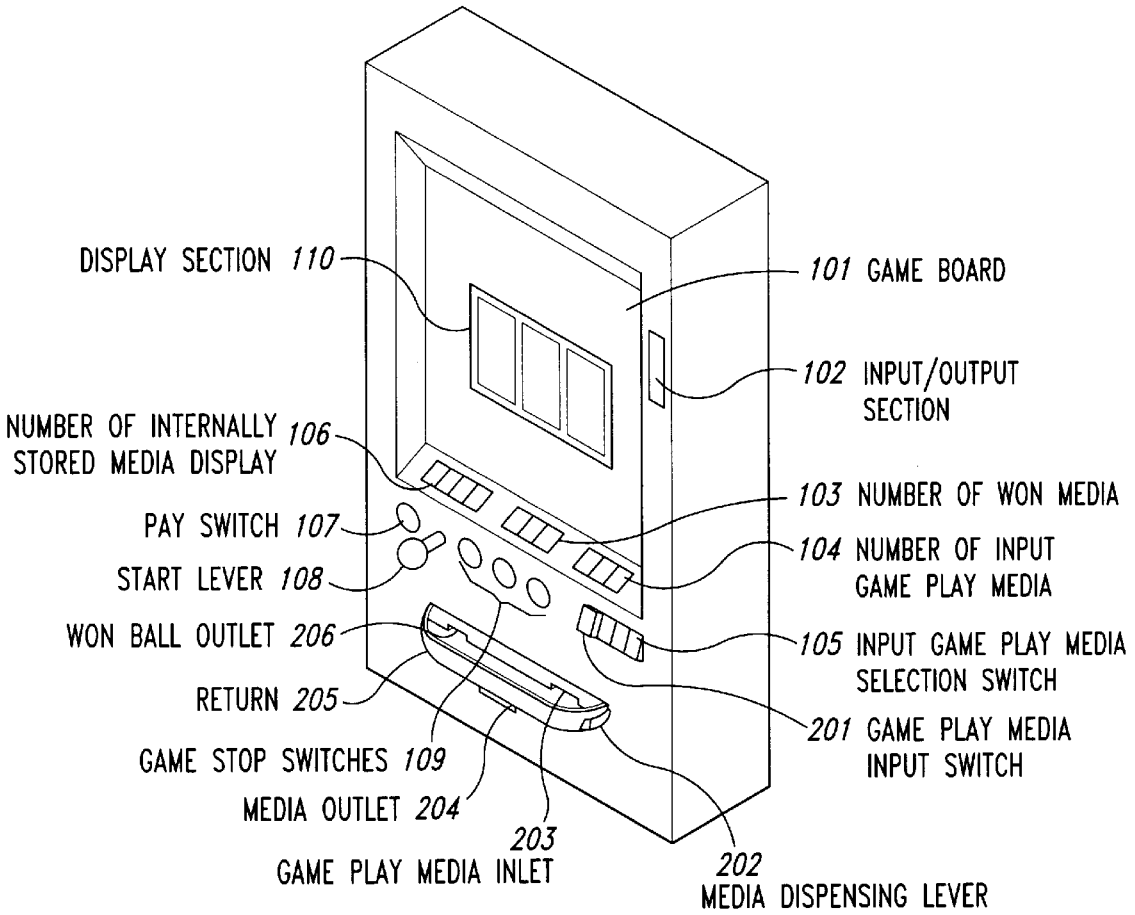
FIG. 2 is an external view B of a slot machine comprising a display unit.

FIGS. 1 and 2 are external views A and B of the embodiment, wherein a display section 110 is placed on a game board 101. The display section 110 is display means such as a display or liquid crystal for displaying various symbols on the slot machine. A plurality of symbol columns are displayed on the display section 110 as on conventional rotation drums. The symbols can be moved or changed in display sequence, as if they actually rotated. The display section 110 may comprise display means provided for each column. A winning symbol combination line may be displayed during the game, or when a symbol combination completes a predetermined symbol combination, a message or the like indicating the event may be displayed. An input/output section 102 is provided to input/output game play media such as medals used with normal slot machines, bills, coins, or a card recording the amount of money, the number of medals, etc. Number of won media, 103, is display means for displaying the number of game play media or the winning count such as the amount of money paid out for the winning game play when the slot machine symbols match predetermined symbols. Number of input game play media, 104, is display means for displaying the number of game play media, the amount of money, or the like input through the input/output section 102. An input game play media selection switches 105 are indication switches for indicating the number of game play media or the amount of money to be bet. For example, the player can use the switch to indicate a winning combination to be set in response to the number of medals. Number of internally stored media, 106, is display means for displaying the number of game play media, the amount of money, or the like stored in the slot machine when the number of won game play media is not output. A pay switch 107 is a switch for instructing the slot machine to pay out the game play media stored in the slot machine at the end of the game. For example, when the player presses the pay switch 107, as many game play media as stored in the slot machine can be paid out to the player or if the player uses a card, the number of game play media stored in the slot machine can be recorded on the card and the card can be dispensed. A start lever 108 is instruction means for accepting instruction to start symbol rotation display in the slot machine. Game stop switches 109, which are provided in one-to-one correspondence with the columns, are instruction means for accepting game stop instructions. When a game stop instruction is accepted from the game stop switches 109, changing of the symbols is stopped at predetermined stop timings. It may be stopped automatically after a lapse of a predetermined time from the start of rotation display, without providing the game stop switches 109.

To further use medals or balls as game play media, the slot machine may further include a game play media input switch 201, a media dispensing lever 202, a game play media inlet 203, a media outlet 204, a return tray 205, and a won media outlet 206, as shown in external view B of FIG. 2. The return tray 205 is provided to receive game play media and is connected to the game play media inlet 203, the won media outlet 206, and the media outlet 204. The game play media input switch 201 is means for instructing the slot machine to input the game play media held in the return tray 205 through the game play media inlet 203. The media dispensing lever 202 is means for instructing the slot machine to output game play media through the media outlet 204.

Figure 3:
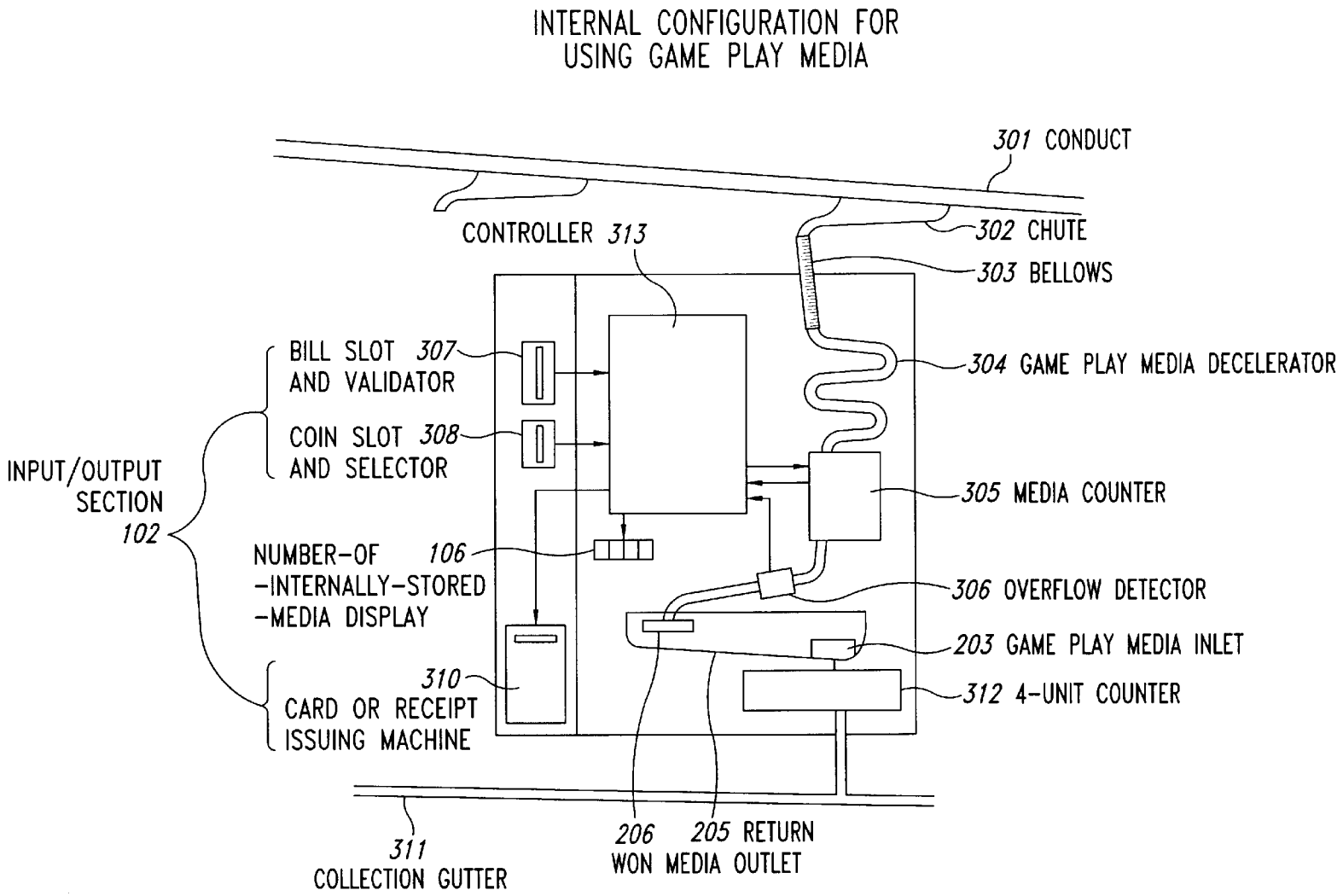
FIG. 3 is an internal block diagram showing how game play media are used.

FIG. 3 shows the internal configuration when using game play media, and when the slot machine has an appearance as shown in FIG. 2. In FIG. 3, a conduct 301 is a passage for supplying game play media, which are brought via a chute 302, a bellows 303, and a game play media decelerator 304 into a media counter 305 for counting the number of game play media. An overflow detector 306 detects a condition in which game play media cannot be output through the won media outlet 206 because the return tray 205 has become full with game play media. A 4-unit counter 312 counts the number of game play media input through the game play media inlet 203. The input/output section 102 can comprise a bill slot and validator 307, a coin slot and selector 308, and a card reader/writer 310. A controller 313 is a control section for managing input/output of game play media and controlling game plays, and display on the display section 110.

When game play media are not used as shown in FIG. 1, the internal configuration of the slot machine may comprise the controller 313 and the input/output section 102 as shown in FIG. 3.

Next, the detailed internal configuration in the embodiment will be discussed with reference to FIG. 4 which is a block diagram of the configuration of a display type slot machine.

Figure 4:
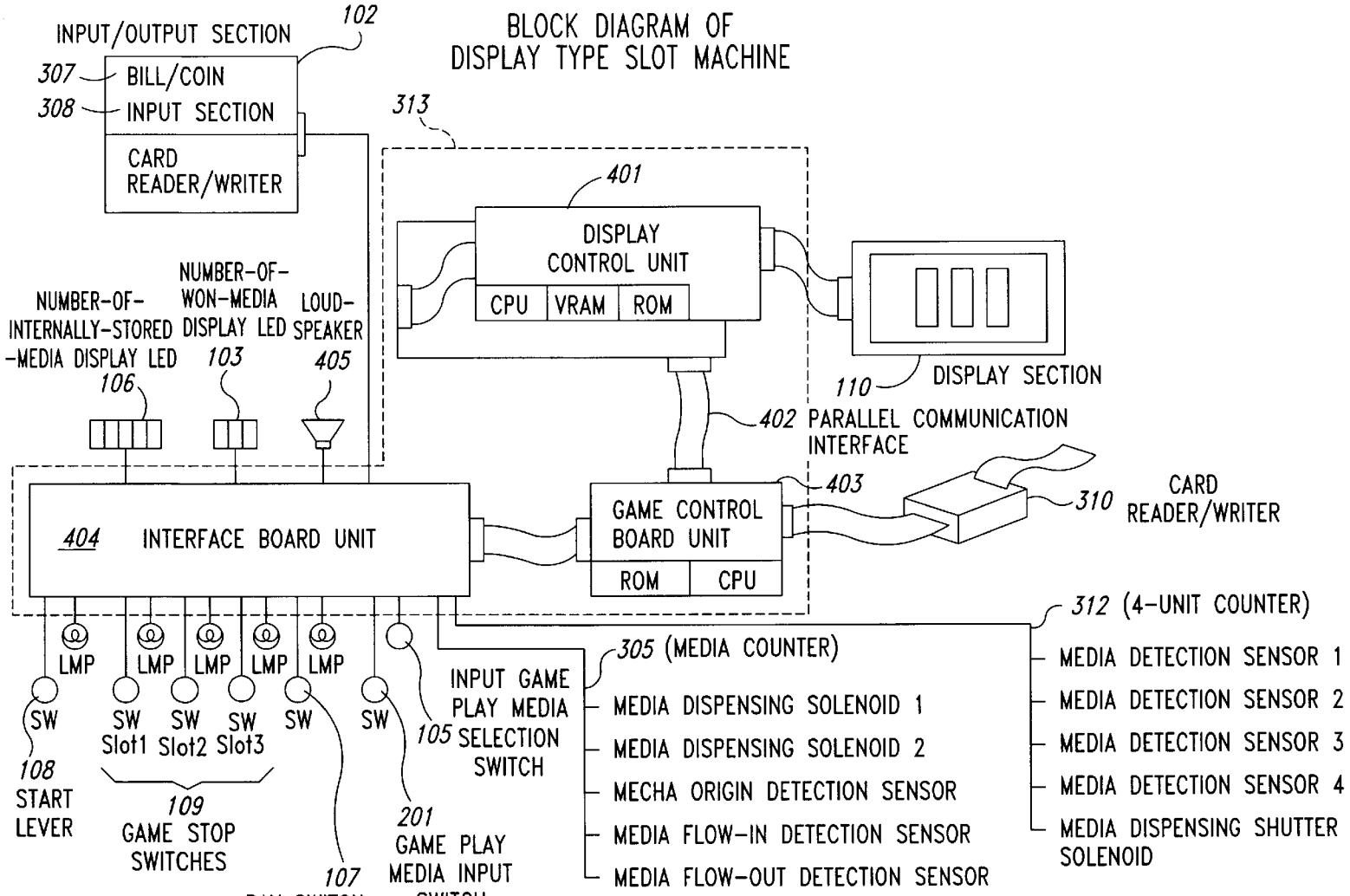
FIG. 4 is a block diagram of the configuration of a display type slot machine.

In FIG. 4, the controller 313 of the display type slot machine comprises a game control unit 403 for controlling game progress, a display control unit 401 for simulating rotation, and an interface board unit 404. In the figure, the game control unit 403 and the display control unit 401 each have a CPU as independent units.

Figure 18:
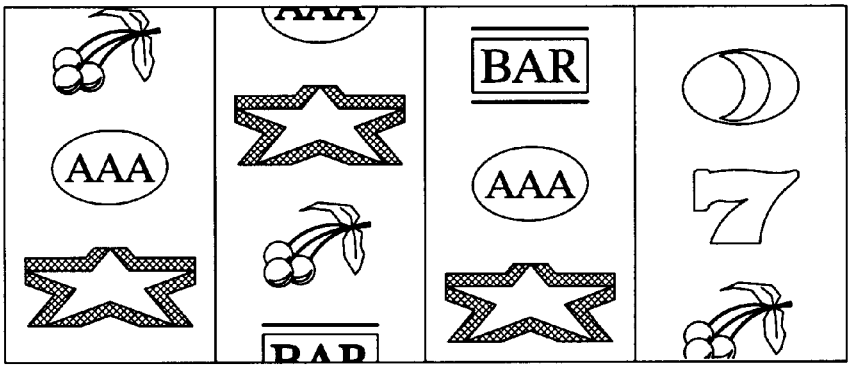
FIG. 18 is a still picture pattern illustration.
Figure 19:
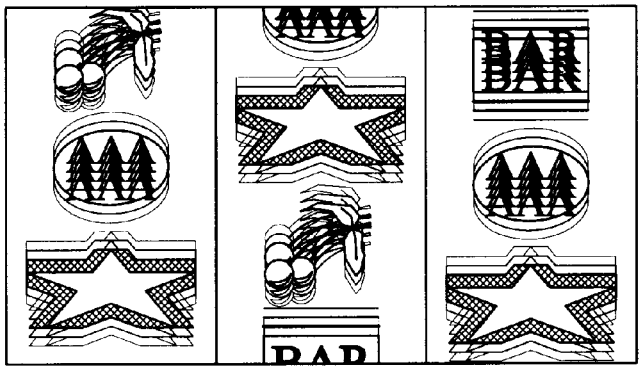
FIG. 19 is a flow condition pattern illustration during a rotation operation.
Figure 20A:
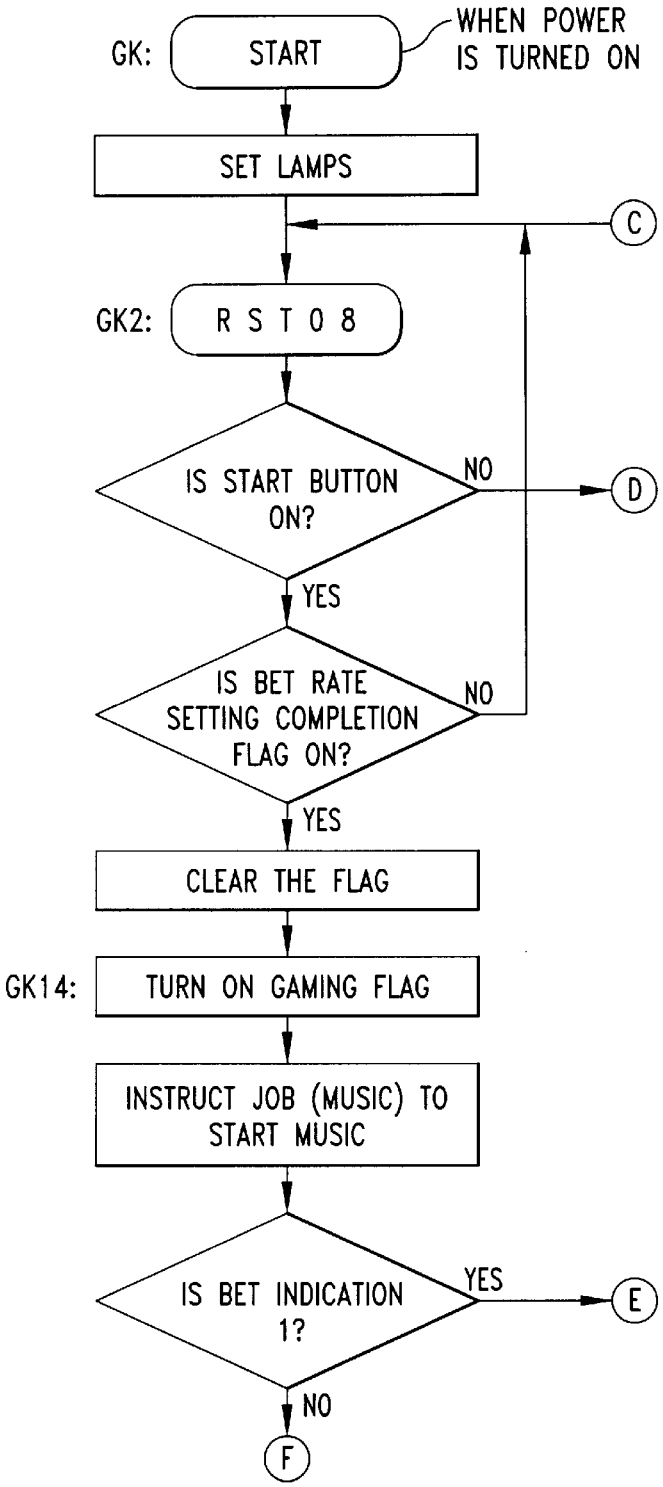
FIG. 20 is a game flowchart 1.
Figure 20B:
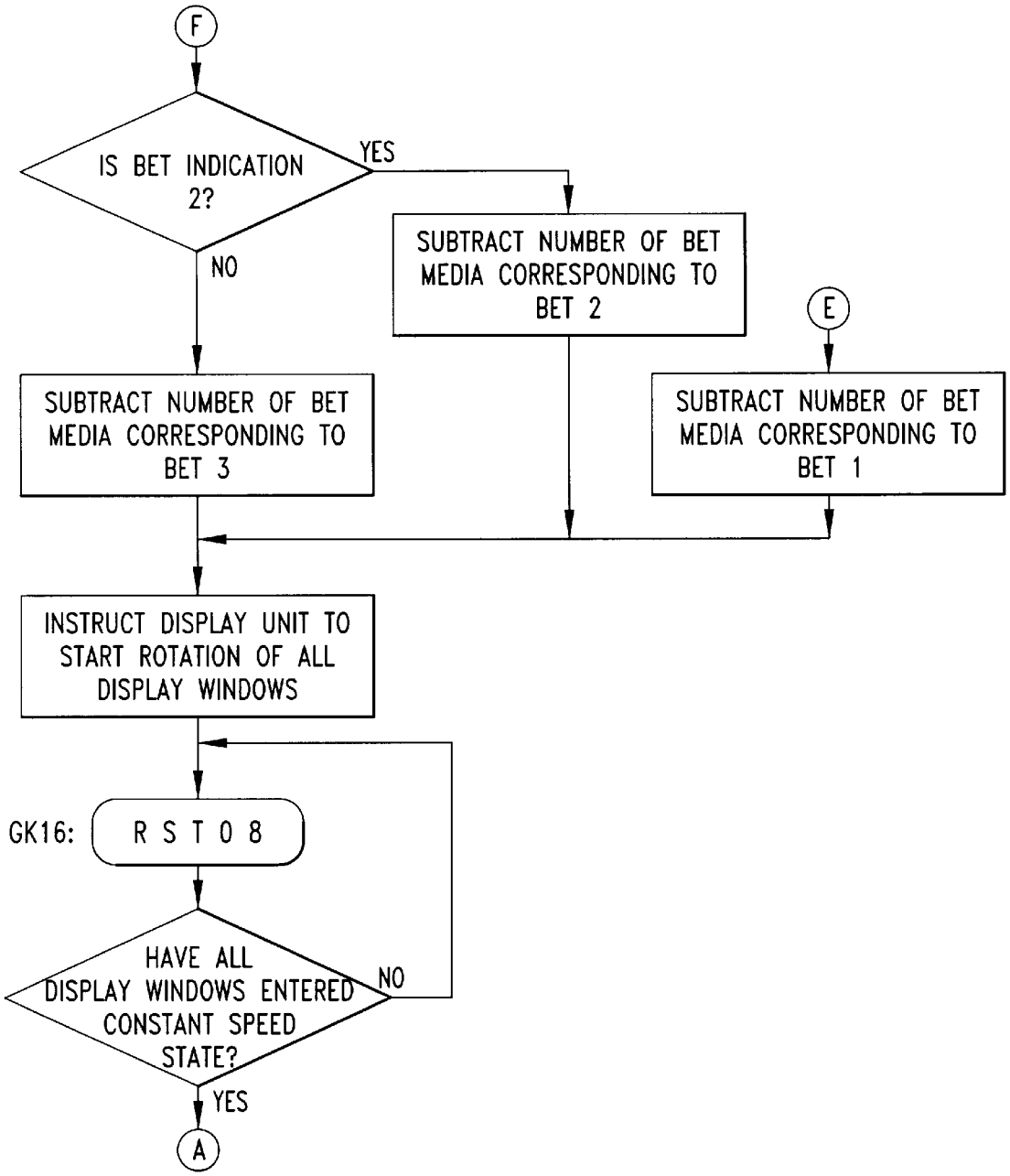
Figure 20C:
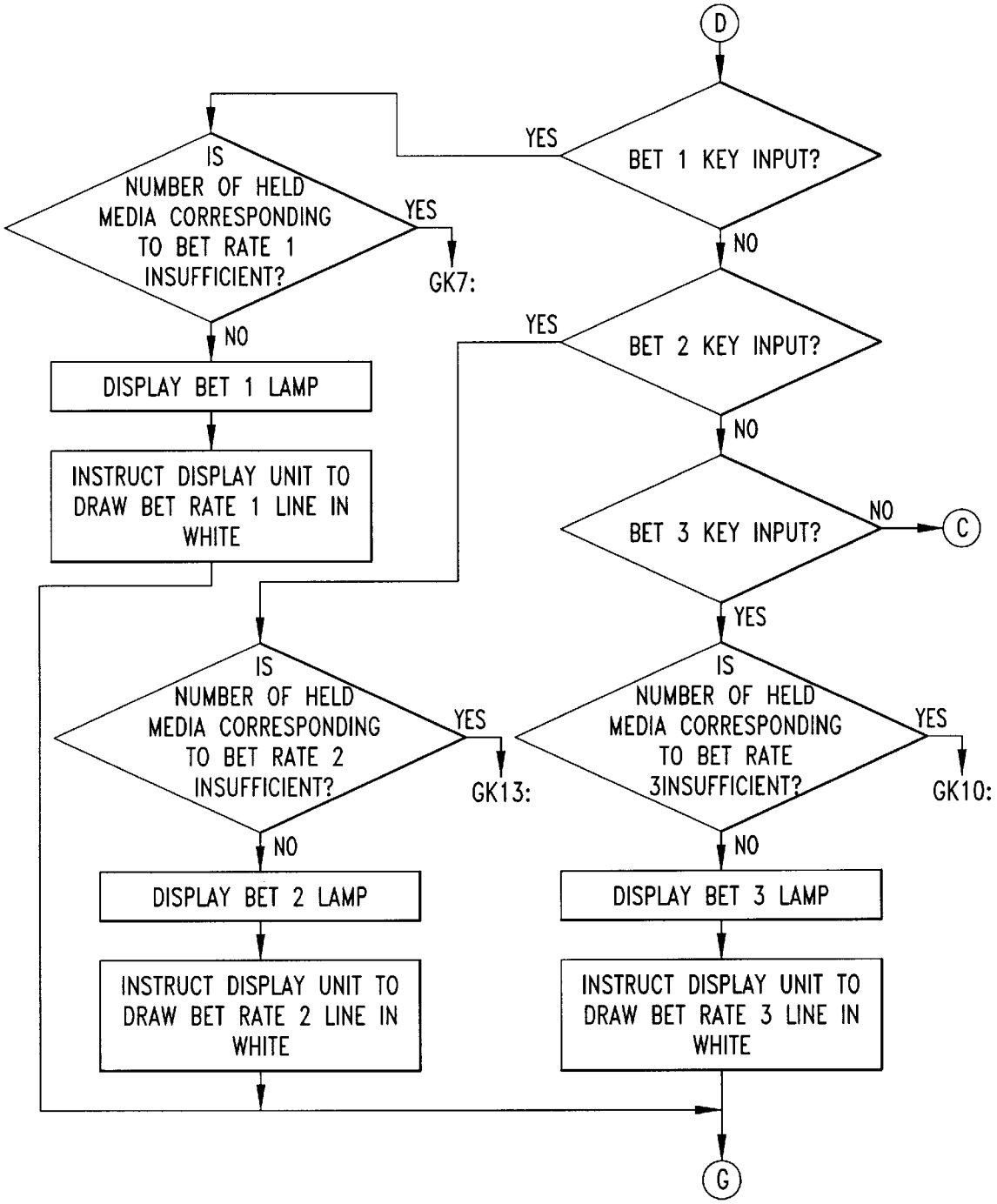
Figure 20D:
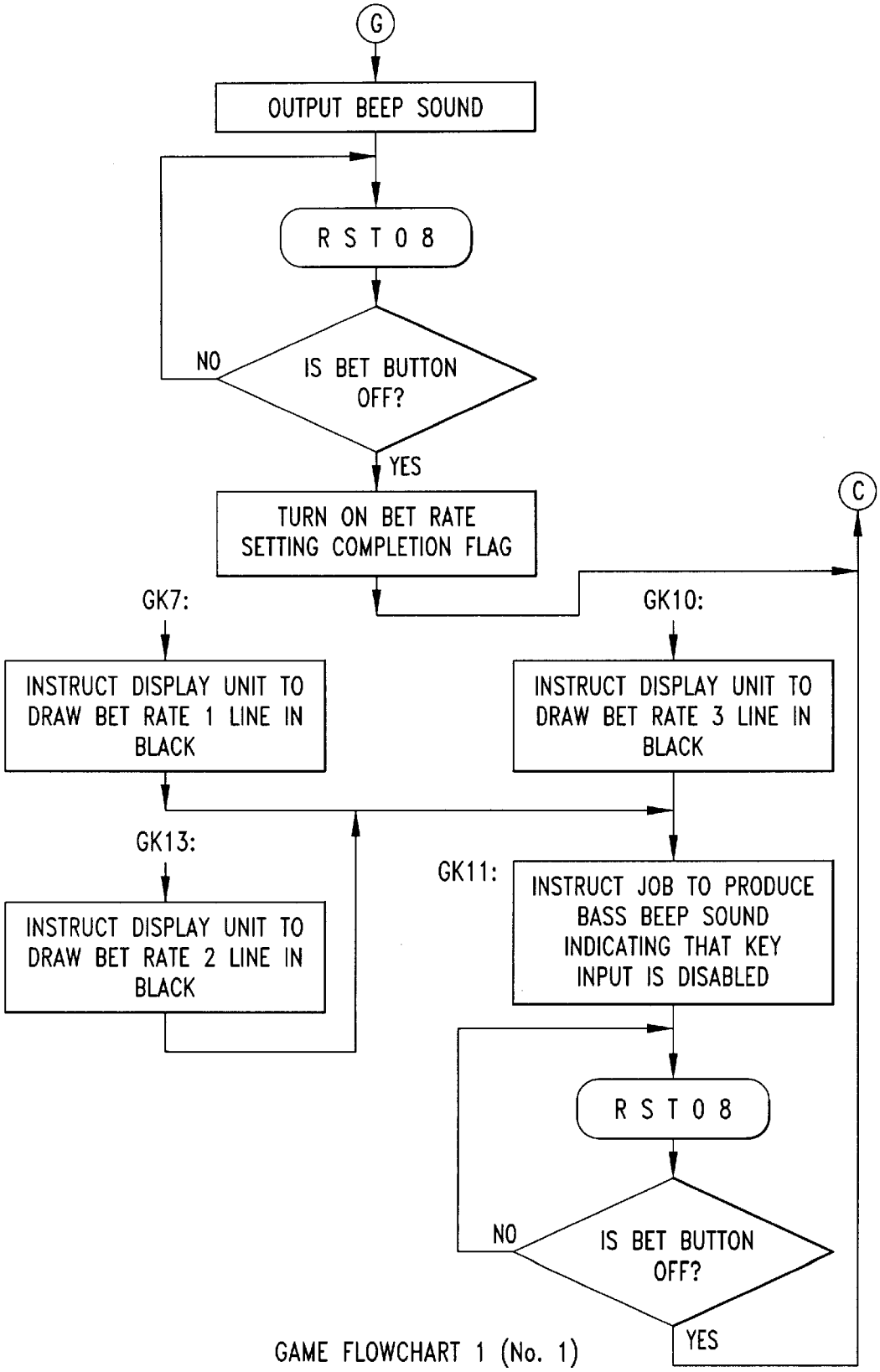
Figure 21A:
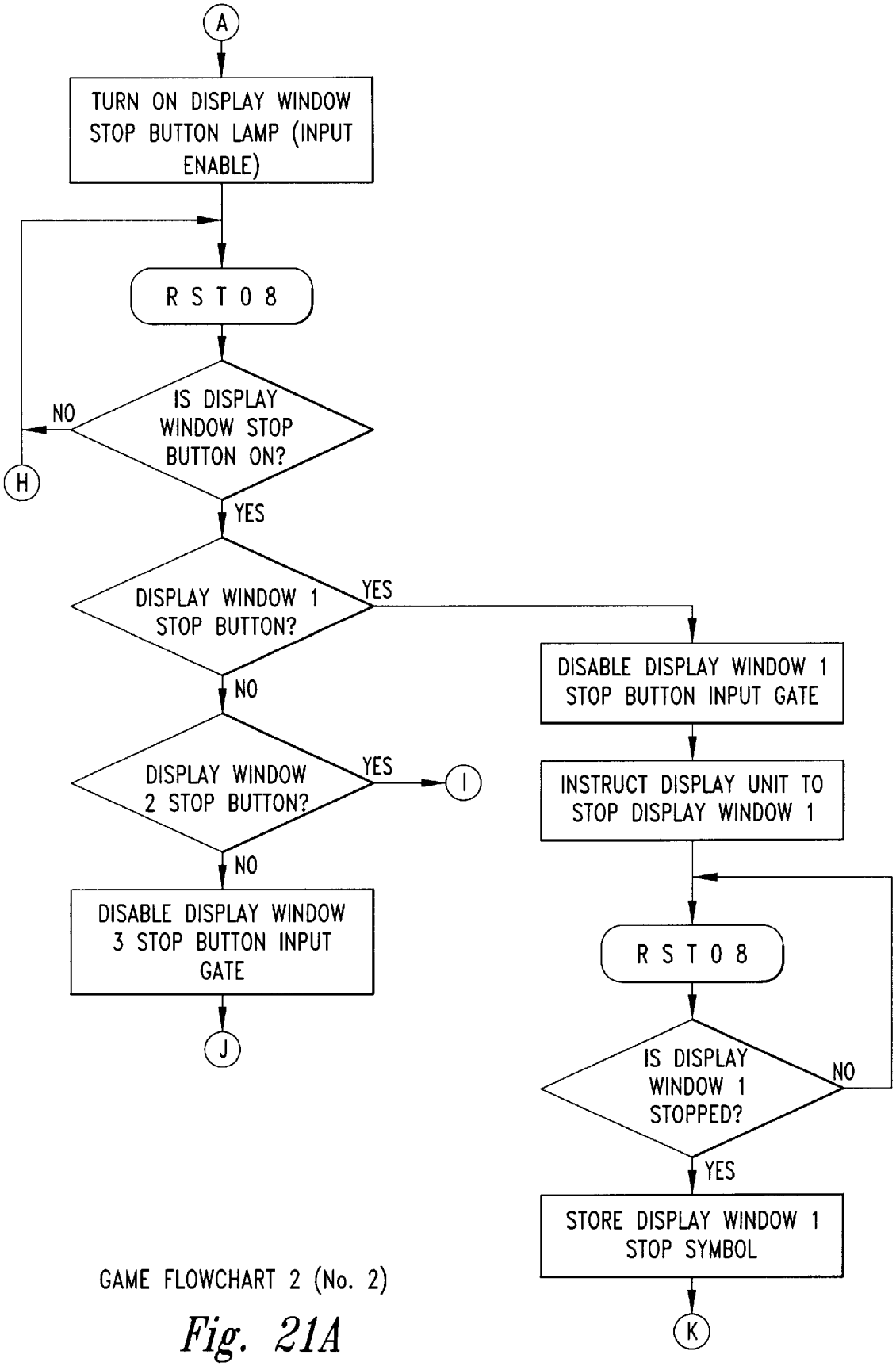
FIG. 21 is a game flowchart 2.
Figure 21B:
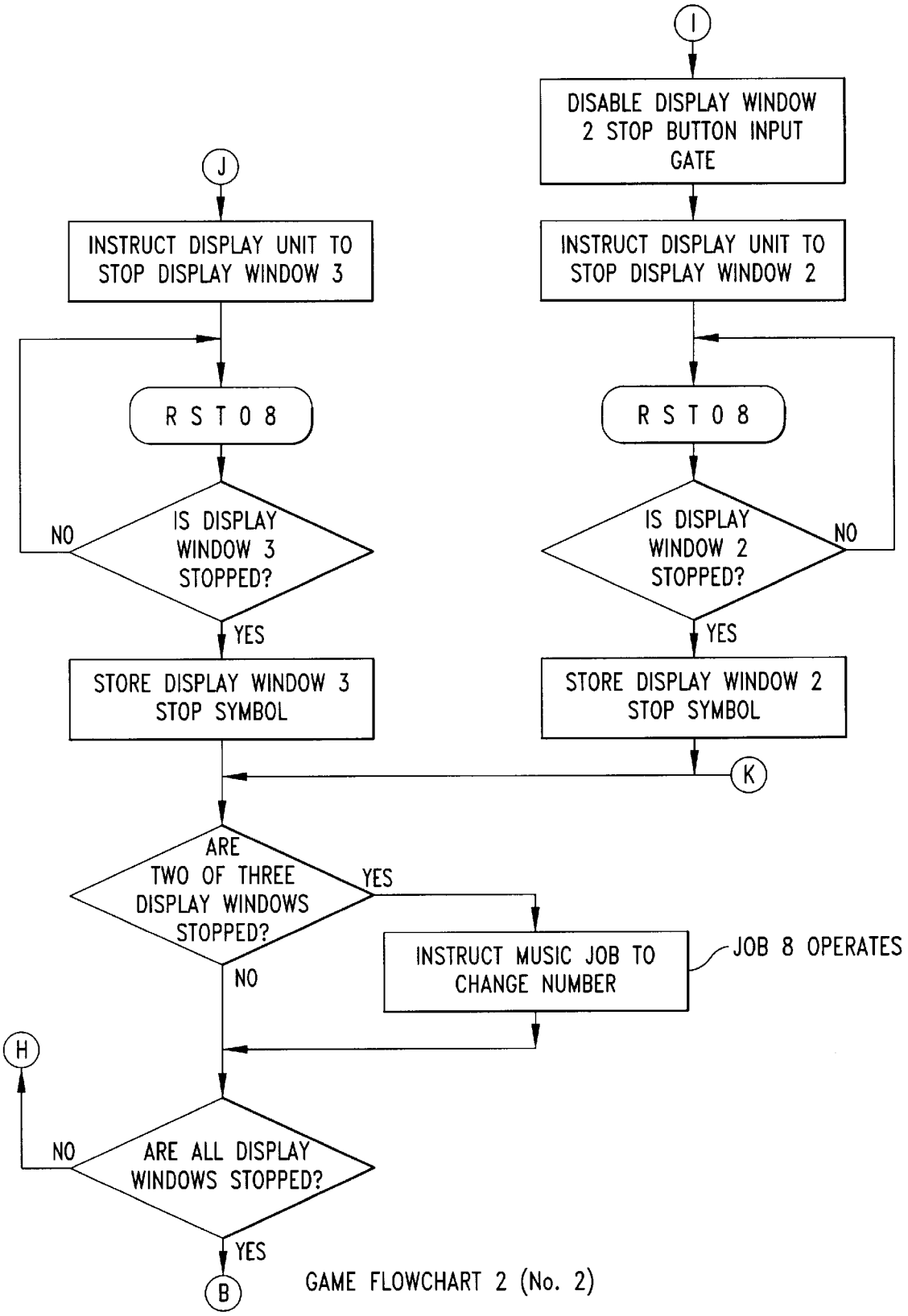
Figure 21C:
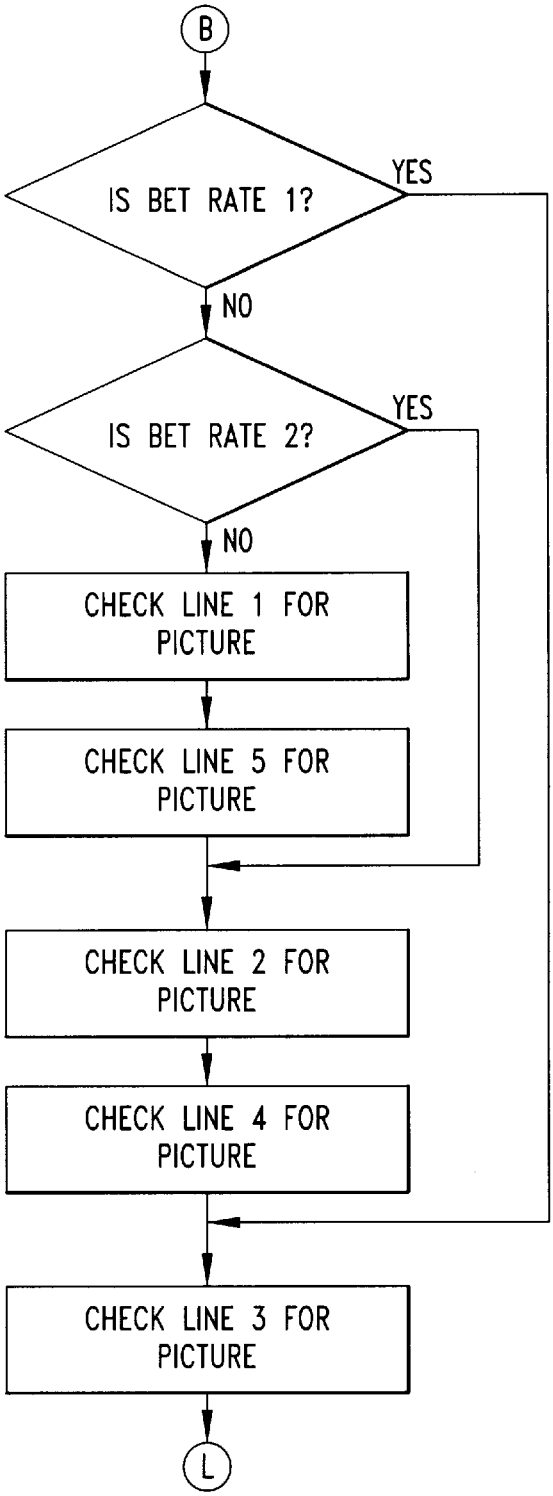
Figure 21D:
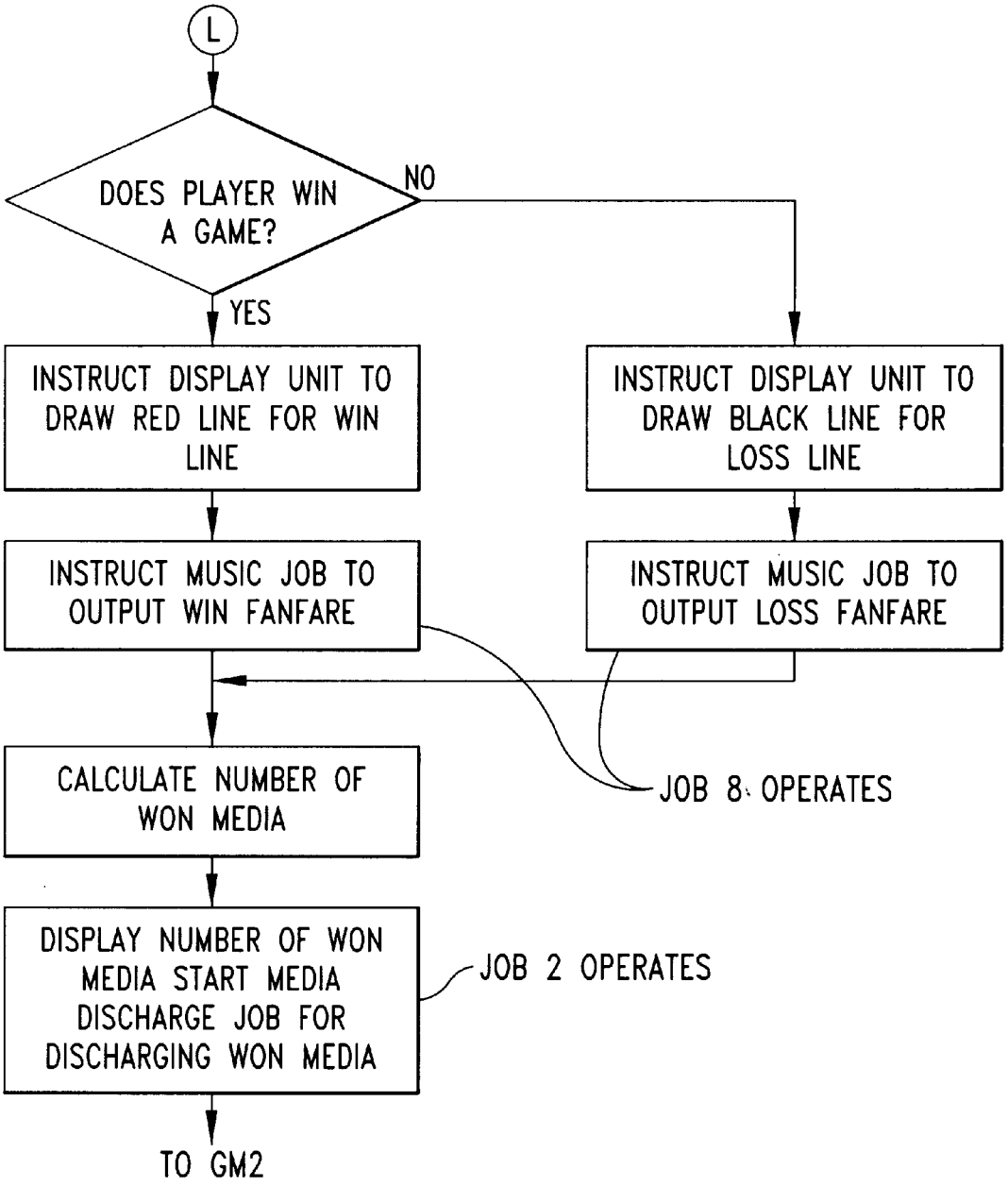

During the system operation, the game control unit 403 plays a main role in controlling game progress in accordance with programs stored in a ROM (read-only memory). It transmits display window rotation and stop instructions to the display control unit 401 via a parallel communication interface 402 for game progress. When the display windows stop, the game control unit 403 determines that the combination of symbols displayed at predetermined positions on the display means matches a predetermined symbol combination. To display various symbols as if they had rotated, the display control unit 401 comprises a ROM storing various symbol patterns and a VRAM (video random access memory) storing background pictures for changing the display of the symbols on the display windows. A plurality of display window display operation modes, such as stop, acceleration, constant speed rotation, and deceleration modes, are provided, and their symbol data is transmitted to a display section 110 in frame span units. The symbol patterns stored in the ROM are provided corresponding to still picture patterns in the stop mode, the acceleration mode, and the deceleration mode and flow condition patterns showing an apparently flowing condition in the symbol pattern moving state to provide display like a dynamic image in the constant speed rotation mode. The ROM may be detachable or an erasable and programmable read-only memory (EPROM) or an electrically erasable and programmable read-only memory (EEPROM) may be used as the ROM. Normal still pictures, for example, as shown in FIG. 18, are stored as the still picture patterns, and symbol patterns, like symbols flowing as if actual mechanical drums had rotated, as shown in FIG. 19, are stored as the flow condition patterns for the rotation operation. The display control unit 401 changes symbol patterns read between the static picture and flow condition patterns stored in the ROM in response to the display operation mode. The display section 110 superimposes the symbol pattern in each display mode on a background picture stored in the VRAM for display. The interface board unit 404 connects the input/output section 102, indication and instruction switches, display means, etc., and is controlled by the game control unit 403. The indication and instruction switches include at least a start lever of the start instruction means, for accepting a game start instruction and sending a game start instruction to the display control unit 401 so as to change symbol display for each column, and stop instruction means for accepting a game stop instruction to stop symbol change for each column and sending a stop instruction to the display control unit 401. The slot machine may further include a loudspeaker 405 for outputting a sound when symbols are completed, etc.

As shown in FIG. 4, the embodiment replaces parts such a pulse motor drive, pulse motor, drums, and a pulse motor position detector in conventional mechanical slot machines, with the display unit.

Figure 8:
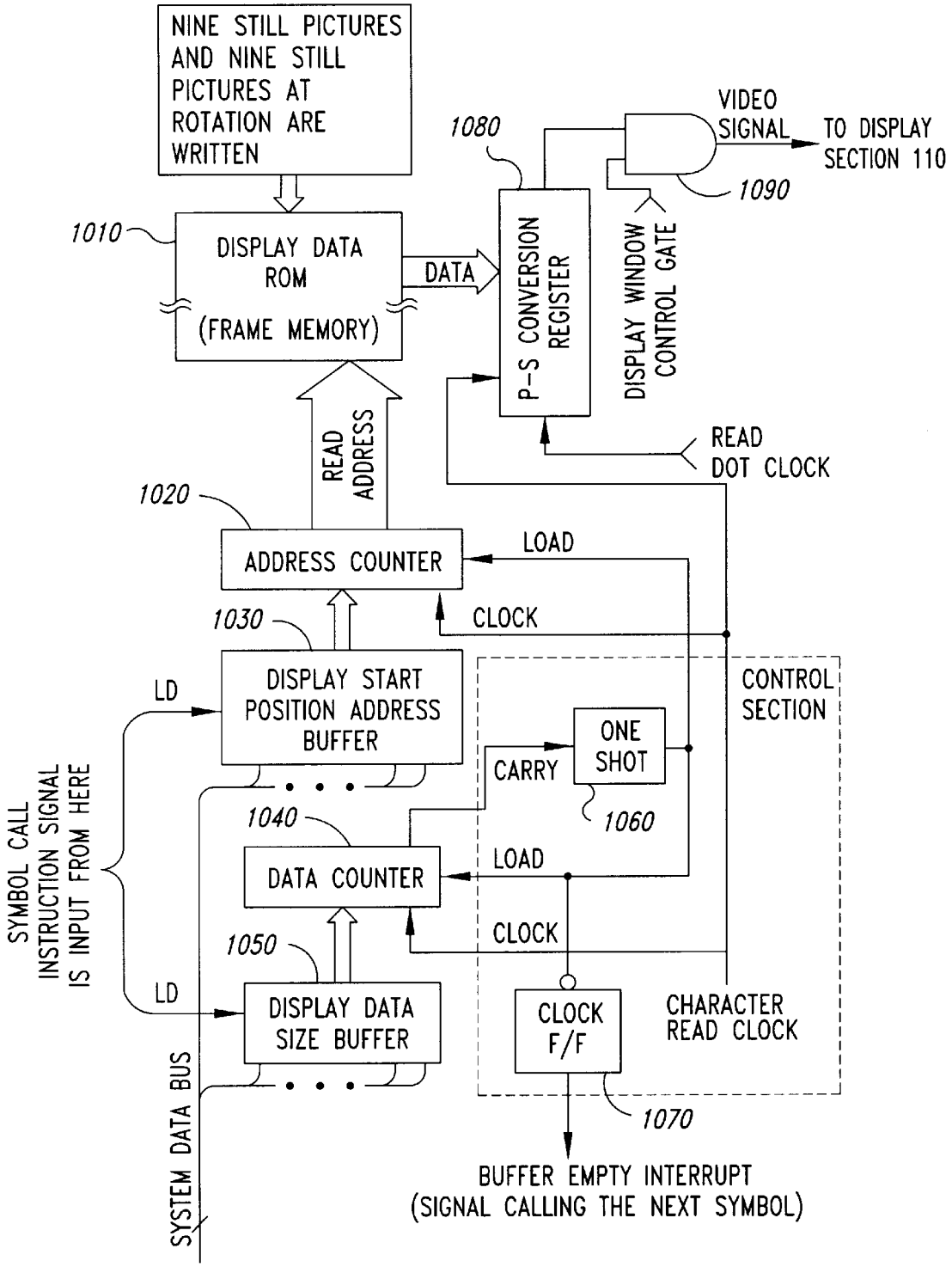
FIG. 8 is an illustration of the high-speed screen change of a display unit.

Next, the configuration of the display control unit 401 will be discussed with reference to FIG. 8. The display control unit 401 comprises VRAM storing background pictures, ROM storing display data of slot machine symbols, and address generation means for changing screens at high speed. The functions of the parts in FIG. 8 are described below:

1 All symbol data to be displayed is stored in the display data ROM. Information as to which symbol starts at which address of the ROM is stored as a pattern register in a system memory.

2 An address counter section, which is a counter for reading the display data ROM contents, counts up or down in sequence according to a character read clock.

3 A display start position address buffer is a buffer for storing the read start address of the next symbol to be displayed. Upon completion of display of the preceding symbol, data is loaded into the address counter section.

4 A data counter, which is a counter for checking what byte (or word) of the display symbol is to be displayed, counts down according to a character read clock. When it reaches 0, new data is loaded.

5 A display data size buffer is a buffer for storing data defining the number of bytes (or words) of the next symbol to be displayed. When the data counter reaches 0, the buffer contents are read into the data counter.

The address generation means comprises the address counter section, display start position address buffer, data counter, and display data size buffer mentioned in above sections 2, 3, 4, and 5, respectively.

Next, the operation in FIG. 8 will be discussed.

1. The main routine in the display control unit consults a symbol data reference table, generates the <display start position address> and the <display data size> of the symbol to be displayed as a 1-frame table, and passes the table to a buffer empty interrupt routine.

2. The buffer empty interrupt routine then loads the first address data and first data size data into the address counter and the data counter respectively at the Vsy timing based on the passed table loads the second data into the buffers, and waits for a buffer empty interrupt. In response to a buffer empty interrupt, the buffer empty interrupt routine loads the third and later data in sequence.

3. In the current frame, the main routine generates a table of data to be displayed in the next frame.

Thus, addresses are generated by the address generation means and symbol data of the display windows is read from CG-ROM. In the display control unit, display symbol data is stored in the display data ROM corresponding to a frame memory and still picture symbol data and still picture symbol data at the rotation time are stored, whereby when several tens of symbol patterns are changed and displayed for each frame span, even if a slow CPU such as a Z80 is used, a memory-to-memory move of display screen data is eliminated. Therefore, the CPU load is relieved and even a slow CPU can be used. The display control unit will be discussed later in detail with reference to FIG. 9.

Figure 17:
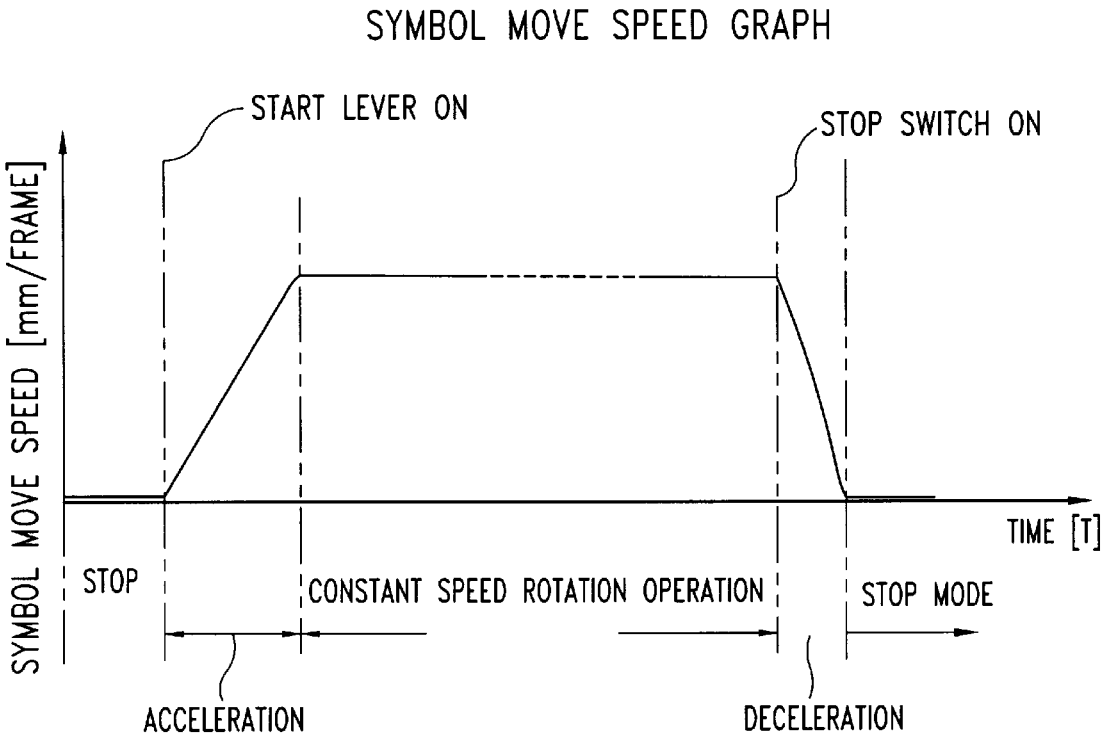
FIG. 17 is a symbol movement speed graph.

Next, FIG. 17 is a symbol movement speed graph in the display stop mode, acceleration mode, constant speed rotation operation mode, and deceleration mode, wherein the horizontal axis denotes time and the vertical axis denotes the symbol move speed (mm/frame). In the stop mode, no symbols movement and the same symbol is updated every frame. When the start lever 108 is operated and a rotation display start instruction is accepted, the display windows make the transition to the acceleration mode, and the speed is accelerated until a predetermined symbol movement speed is reached. When the predetermined symbol movement speed is reached (or the given time has elapsed), the transition to the constant speed mode is made. When the game stop switches 109 are pressed (or a given time has elapsed), deceleration is made at a predetermined deceleration rate for each display window corresponding to each stop switch. When a predetermined symbol movement speed is reached (or a given time has elapsed), the stop mode is entered. To display symbols so that they move at the speeds as shown in FIG. 17, the display control unit 401 comprises address generation means for generating the read top position and read amount of each of the symbols displayed at the top stage, second stage, third stage, etc., for each mode. In the embodiment, the symbol read top positions and read amounts for each mode are stored in storage means in relation to frames.

Figure 9:
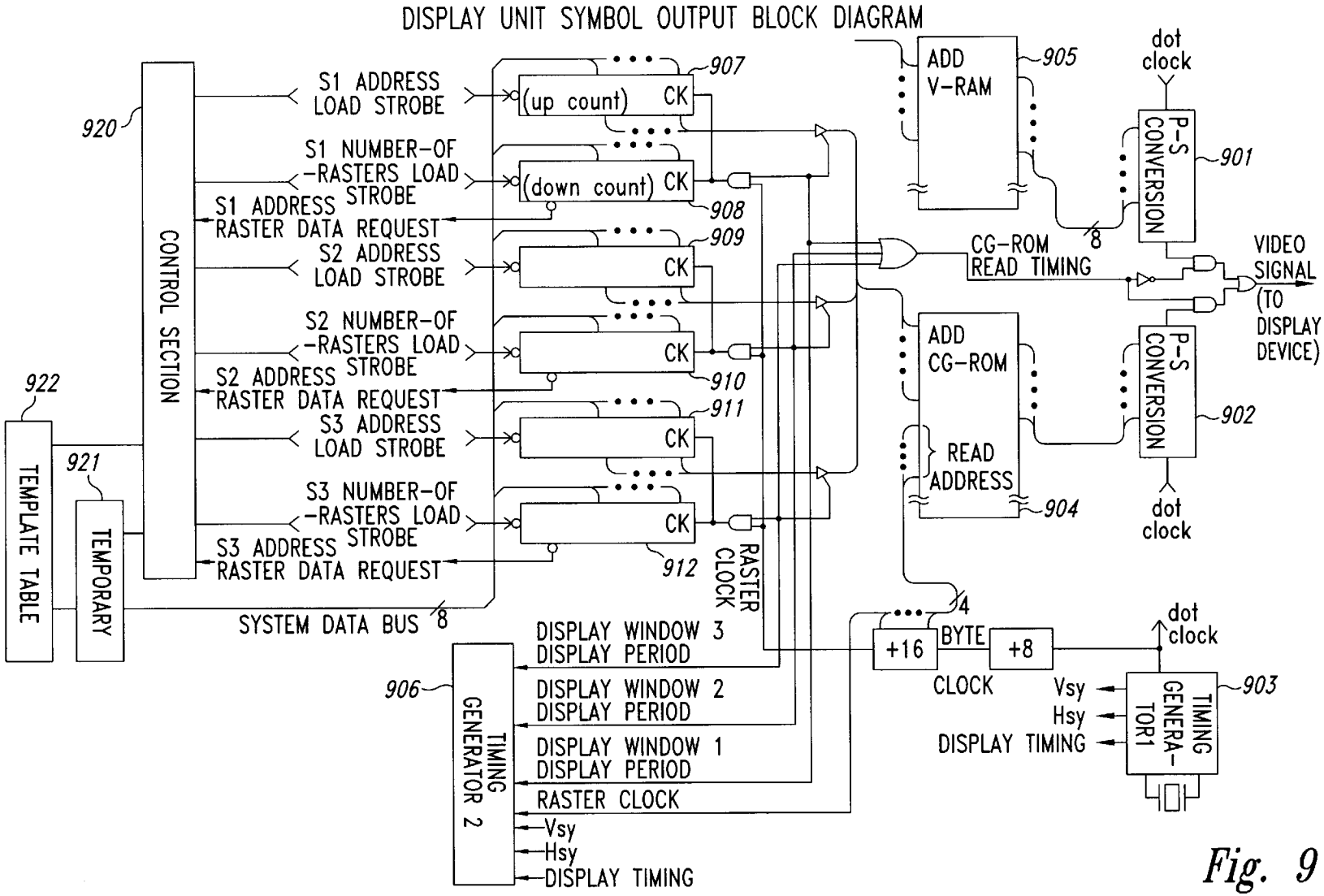
FIG. 9 is a symbol output block diagram of the display unit.
Figure 10:
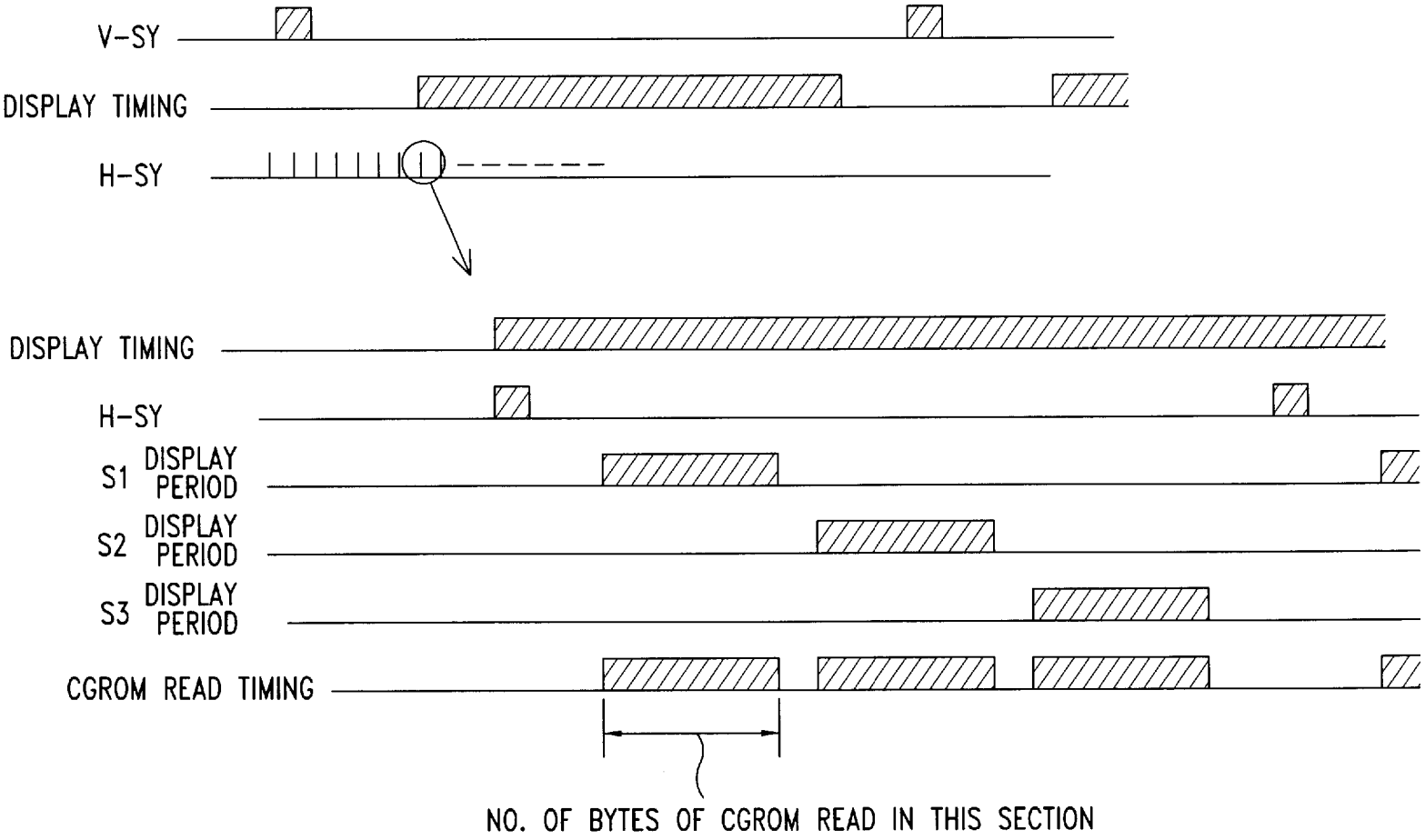
FIG. 10 is a display timing chart.
Figure 11:
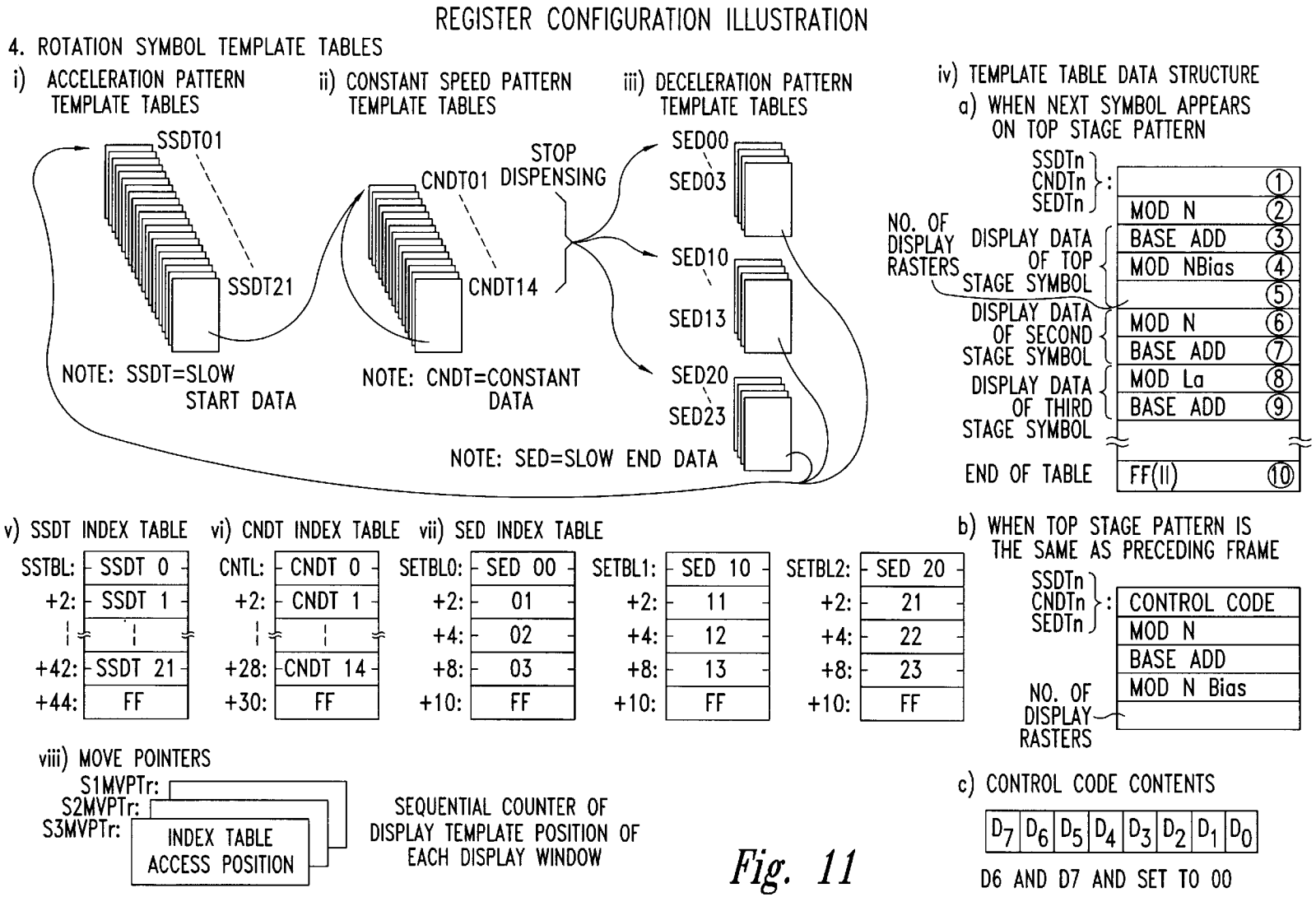
FIG. 11 is a register configuration illustration.
Figure 12:
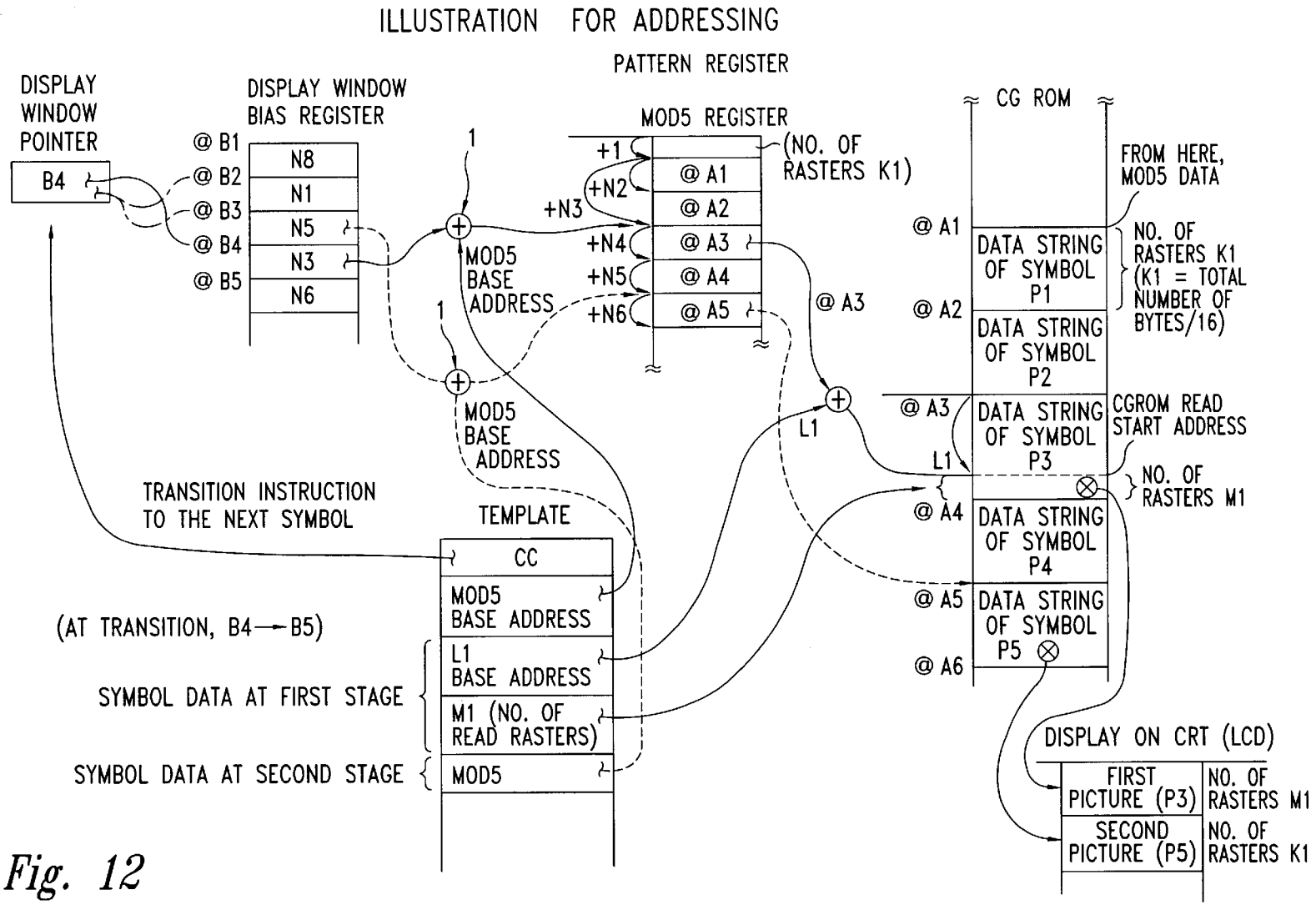
FIG. 12 is an illustration showing addressing.

The display control operation in the display control unit 401 will be discussed with reference to FIGS. 9 to 12. FIG. 9 is a block diagram showing symbol output of the display control unit 401. FIG. 10 is a display timing chart. FIG. 11 is a register configuration illustration. FIG. 12 is an illustration showing addressing.

In the display control unit 401, still picture and flow condition patterns are stored in the CG-ROM for each symbol as described above, and the CG-ROM is addressed to read and display the symbols. Assume that the display section 110 displays for each display window column and displays predetermined areas as the display areas of the column, for example, it can display about four symbols at the same time. The display section 110 updates display in a frame span of a given interval of 1/60 or 1/30 sec (V-sync period), and line scanning is performed for each frame. The display control unit 401 reads the symbols to be displayed in the display areas of the columns for each frame, and in the stop mode, displays the same symbols. During the rotation operation, it moves the display positions of the symbols displayed in the display areas of the columns. That is, when reading the symbols from the ROM, the display control unit 401 shifts the read top position by movement distance for each frame to read the symbols to be displayed within the display area range, and displays the symbols as if they had rotated by reading the symbols in a predetermined order. Further, in the embodiment, the movement distance is changed in the acceleration mode, constant speed mode, and deceleration mode. In the acceleration mode, a change is made from still picture pattern read to flow condition pattern read.

Figure 13:
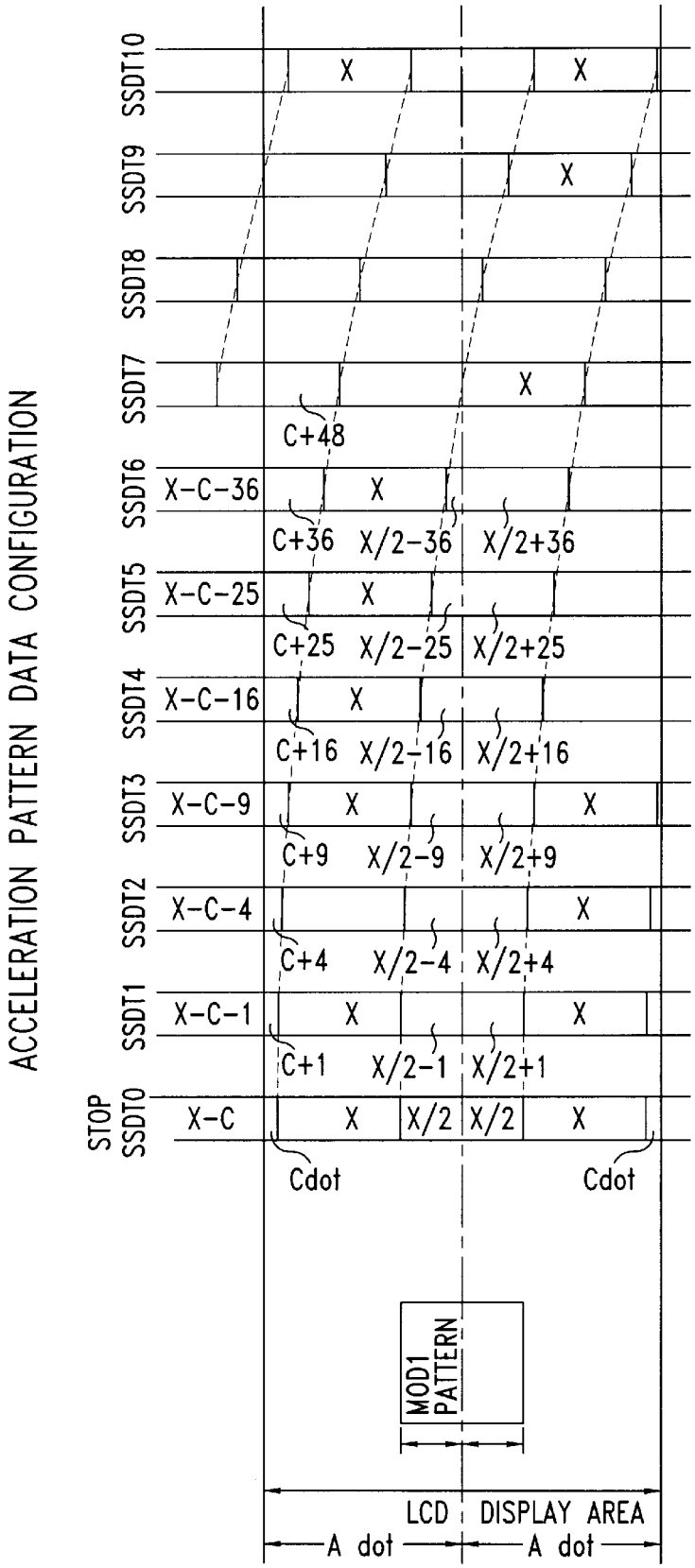
FIG. 13 is an acceleration pattern data configuration diagram.
Figure 14:
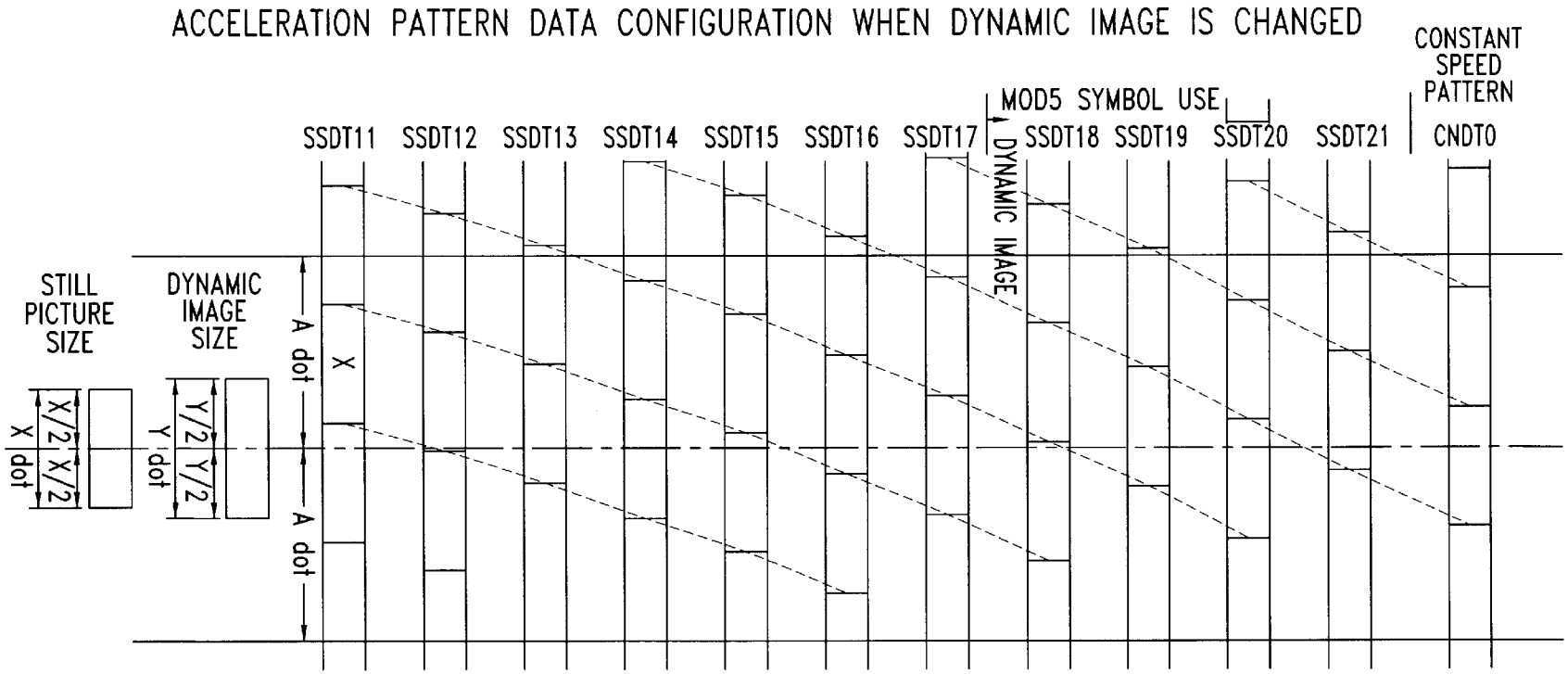
FIG. 14 is an acceleration pattern data configuration diagram.
Figure 15:
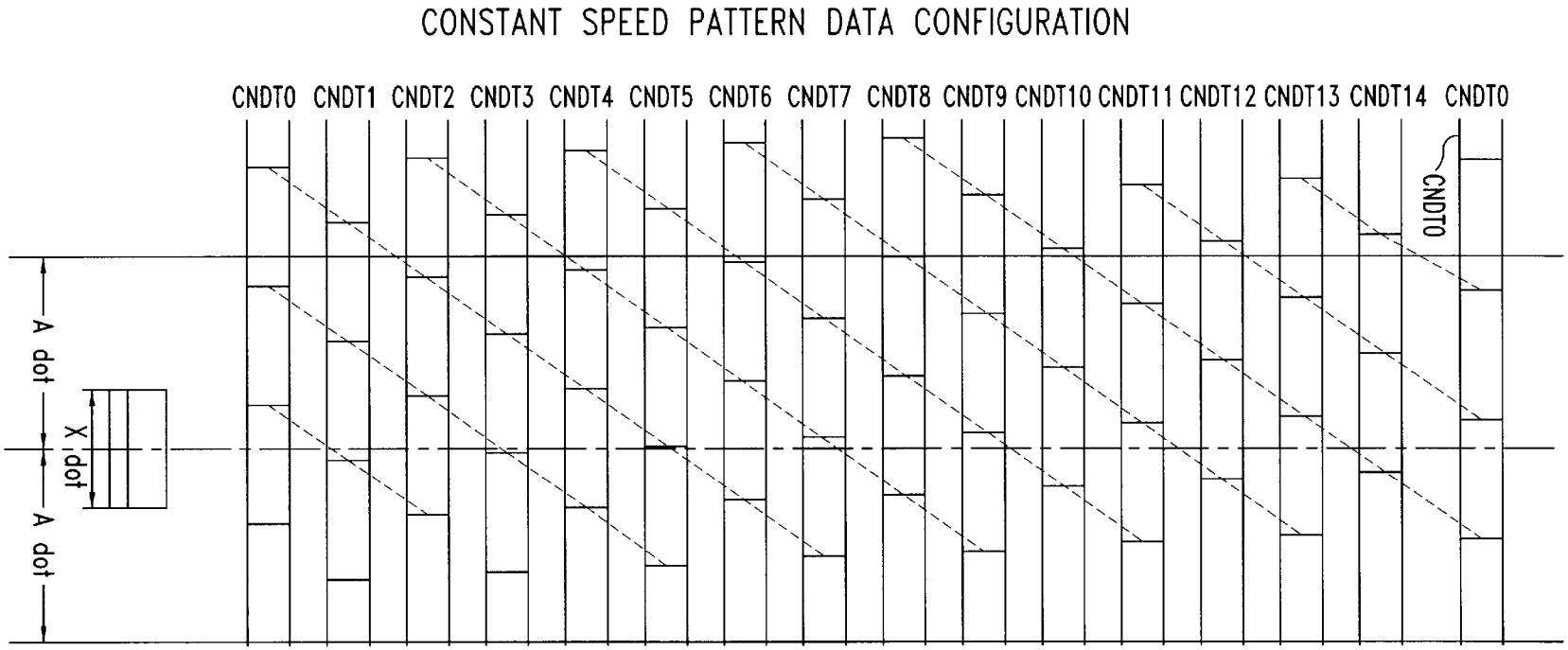
FIG. 15 is a constant speed pattern data configuration diagram.
Figure 16:
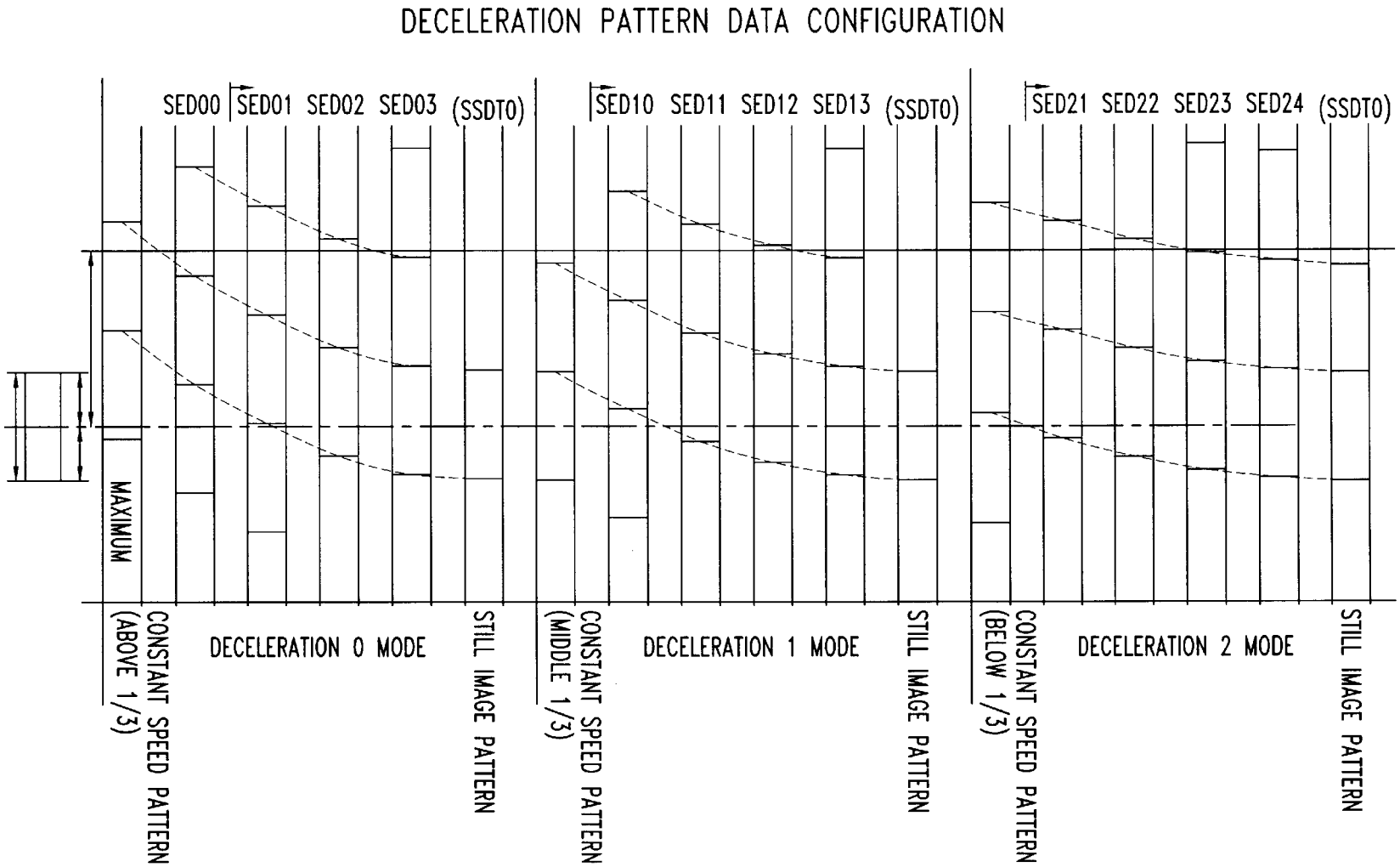
FIG. 16 is a deceleration pattern data configuration diagram.

Before the detailed operation of the display control unit 401 is discussed, the movement distance change will be described with reference to FIGS. 13 to 16. FIG. 13 shows the acceleration mode data configuration. FIG. 14 shows the acceleration mode data configuration when the screen is changed. FIG. 15 shows the constant speed mode data configuration. FIG. 16 shows the deceleration mode data configuration.

In FIGS. 13 to 16, assume that the vertical size of the display area of the display section 110 is (A+A) dots and that the vertical size of each symbol is X dots. In FIGS. 13 and 14, SSDT0–SSDT21 indicate the display positions of each symbol in frames in the acceleration mode. The symbols are shifted by a predetermined movement distance for each frame for display. Each frame displays the symbol at the top stage, that at the second stage, that at the third stage, that at the fourth stage, etc., on the screen. SSDT0–SSDT21 are template tables corresponding to the frames and store at least the read top positions and read amounts from the top stage to the bottom stage. In FIG. 15, CNDT0–CNDT14 tables are provided for the constant speed mode; symbols are repeatedly displayed until a stop instruction is issued. In FIG. 16, SED00–SED03 tables are provided for the deceleration mode and finally the transition to the stop mode is made. As shown in FIG. 16, a plurality of deceleration modes may be provided. For example, one of the deceleration modes may be selected according to the display amount of the symbol at the top stage displayed when a stop instruction is given. In the embodiment, a change is made from a still picture pattern to a flow condition pattern when SSDT18 for the acceleration mode is applied.

FIG. 11 (iv) shows a data structure example of the template tables, wherein 1 denotes a control code which is a flag byte indicating which of a new symbol pattern and the same symbol pattern is to be displayed for the preceding display frame. For example, a code indicating whether or not the symbol at the top stage changes, a code indicating whether or not the symbol mode changes, a code indicating selection of the deceleration mode when a stop instruction is given in the next frame, a code indicating the current mode, etc., can be preset. 2 denotes identification information of the display pattern (still image pattern or flow condition pattern) read for the symbol at the top stage. 3 is a base address indicating the top position of the display pattern in the ROM. 4 is a bias value indicating the number of rasters from the top to the display start position for indicating at which position of the symbol the symbol display is started at, whereby the ROM read top position can be determined. 5 denotes the total number of display rasters. 6 and 7 denote symbol display data at the second stage and 8 and 9 denote symbol display data at the third stage.

Next, the template processing procedure will be discussed with reference to FIG. 11.

In FIG. 11, movement pointers are provided for indicating the template table positions. Each movement pointer can be provided by a counter indicating the display template position of each display window and counting the Vsy signal in sequence. The data read from a template table is temporarily stored in a temporary work area.

(1) When the slot machine power is turned on, the display control unit reads template SSDT0 (stop mode) repeatedly.

(2) Upon receipt of a rotation request from the game side, the template is changed to SSDT1 and template SSDT1 data is expanded. The data expanded for the next frame is written into the temporary area.

(3) Each time the frame is updated, that is, each time a Vsy interrupt arrives, the template is changed to SSDT2, SSDT3, . . . This step is repeated.

(4) When the acceleration template processing terminates, constant speed template processing is started and performed in a similar manner to the above by repeatedly making a loop of CNDT14→CNDT0.

(5) Upon receipt of a display window stop instruction from the game side, the template is changed to rotation stop templates, which are expanded in sequence. When the stop template SSDT0 is reached, the display display window is stopped.

(6) The template processing is performed separately for each of display windows 1 to 3.

Next, CG-ROM addressing will be discussed with reference to FIG. 12.

In FIG. 12, display symbol data is stored in the CG-ROM and when the ROM is accessed, the data is directly output onto the CRT (or LCD) as video data. Therefore, this eliminates the need for temporarily transferring symbol data to the VRAM for reading the data as a video signal. Several pattern registers (tables) are provided according to symbol patterns and they store information for each symbol data. The patterns are pattern symbol description variations like still picture and flow condition patterns, as described above.

Each pattern register contains:

(a) the number of rasters of 1-symbol data in the mode (number of rasters=total number of bytes of one symbol÷16); and (b) actual location addresses of symbols, such as seven, BAR orange, cherry etc., in the mode in the CG-ROM, in the form of a table.

In FIG. 12, display window bias registers (tables) are provided in a one-to-one correspondence with display windows 1 to 3; each provides display window symbol arrangement for one revolution with 1-byte codes. That is, the display window bias register stores pattern register addresses corresponding to symbol 1-revolution. The codes operate on the pattern register and are defined as bias values from pattern register base address+one for generating addresses of the ROM data to be displayed. Each display window pointer, which is a counter, serves as a pointer to the display window bias register for pointing to the current rotation point of the corresponding display window. The display window pointer is incremented as indicated by the template contents. Three display window pointers are provided corresponding to display windows 1 to 3. The templates are provided to describe symbol rotation conditions for each frame, as described above. In the embodiment, a total of 49 templates are provided as follows:

(a) stop template SSDT0

(b) acceleration templates SSDT1–SSDT21

(c) constant speed templates CNDT0–CNDT14

(d) deceleration templates SED00–SED03
SED10–SED13
SED20–SED23

The data structure in each template is as shown in FIG. 11 (iv) above. The templates are called in sequence for each frame and indicate the CGROM read top address, the total number of read bytes, etc., for display.

In FIG. 12, the display control unit expands template data read in synchronization with Vsy for generating ROM read addresses as follows:

(a) Whether or not the display window pointer is to be incremented is determined according to the control code in the template indicating whether or not a new symbol pattern is to be displayed for the preceding display frame. That is, if the control code indicates display of a new symbol pattern, the display window pointer is incremented to rotate the display window to the next symbol. For example, in FIG. 13, the next symbol appears within the display screen from above, with the SSDT10 template. In this case, the display window pointer is incremented and the pointer to the display bias register is incremented so that the contents of the display window register indicates the pattern register address of the next symbol.

(b) The ROM area actual location address stored in the pattern register is accessed according to the display window bias register contents pointed to by the display window pointer, the base address of the pattern register specified by the template, and the fixed value 1. For example, the pattern register address is found from the address value of the pattern register indicating the N3 symbol (the address value indicates the distance from the top position of the display pattern register) as the display window bias register contents pointed to by the pointer, the display pattern register top position as the template base address, and the fixed value 1. The pattern register is read based on the pattern register address, and the ROM area actual location address is obtained.

(c) Next, the actual CG-ROM read address is found from the ROM area actual location address and the template base bias value. For example, since the last several bytes of symbol data are read for the first picture on the CRT, the bias value for the read is supplied from the template. The base bias read from the template is added to the ROM area actual address accessed so far to determine the final address for reading the first picture.

(d) The ROM read addresses of the second picture and later are determined on routes indicated by dotted lines in FIG. 12.

Since the symbol arrangement order of the second picture and later is determined, the ROM read addresses are inevitably determined by retracing the display window bias register in sequence. Since incomplete display for the first picture is not required (all symbol data may be displayed), the K1 value written in the pattern register is drawn out for the number of read rasters without the need for base bias L1, number of read rasters M1, etc.

(e) Then, the read addresses of the third and fourth pictures are determined.

(f) The data is temporarily stored in a temporary area in the following format and is read in sequence according to an interrupt request issued from the hardware in the next frame:

Temporary:

First picture ROM read address

Number of first picture read rasters

Second picture ROM read address

Number of second picture read rasters

Third picture ROM read address

Number of third picture read rasters

Fourth picture ROM read address

Number of fourth picture read rasters

Fifth picture ROM read address

Number of fifth picture read rasters

Two temporary areas A and B can be provided. While data is read from A according to an interrupt in the current frame, data required for the next frame can be provided in B. This is repeated.

Next, the hardware operation of the display control unit for reading out symbol display data from the display data storage means storing symbol display data based on the temporary area contents read as described above will be discussed with reference to FIG. 9.

In FIG. 9, P-S conversion means 901 and 902 convert parallel data into serial data. Timing generators 903 and 906 generate timings required in the display control unit. CG-ROM 904 is display data storage means for storing symbol display data. It stores various symbols of still picture and dynamic image patterns. V-RAM 905 is background picture storage means for storing background pictures. Display window 1 address counter 907 indicates the CG-ROM 904 read address in display window 1. Display window 1 raster counter 908 indicates the number of CG-ROM 904 read rasters. Display window 2 address counter 909 and display window 2 raster counter 910 indicate the CG-ROM 904 read address and the number of CG-ROM 904 read rasters for display window 2. Likewise, display window 3 address counter 911 and display window 3 raster counter 912 indicate the CG-ROM 904 read address and the number of CG-ROM 904 read rasters in display window 3. The address counters and the raster counters for display windows 1 to 3 make up address generation means 920 for generating the read top position and read amount. Data is loaded into the raster counters from temporary area 921 in which the numbers of rasters read from the template tables are stored. Each address counter, into which the address of the read top position is loaded from the temporary area 921, counts up according to a raster clock. When as many addresses as indicated by the corresponding raster counter are output, the address of the next display window is output. The control section 920 controls the address counters and the raster counters and issues a data load instruction in response to a data request signal from the raster counter. The display periods of the display windows are divided in a time division manner, as shown in FIG. 10. In the figure, the frame is updated each time the Vsy signal is turned on and 1-raster display data is read according to the Hsy signal.

(1) When a Vsy signal interrupt occurs, data of the ROM read address and the number of rasters of the top stage symbol provided in the temporary area are loaded into all of the address counters, the raster counters, and display windows 1–3.

(2) The address counters are incremented and the raster counters are decremented according to a raster clock in their respective display window display periods for supplying addresses to the CGROM. In the periods, CGROM data is output as video signal.

(3) When the raster counter reaches a count value 0, an interrupt occurs and the raster counter outputs a next data (data for the second picture) request signal.

(4) When receiving the data request signal from the raster counter, the control section 920 sends the ROM read address and the number of rasters of the second picture from the temporary area to the display window making the interrupt request. This step is repeated for the third picture, fourth picture, . . . etc.

(5) When the next Vsy interrupt occurs, the control section 920 performs toggle switching of the temporary area and repeats the operation starting at (1).

(6) In periods other than the CGROM read timings, data is output for display from the V-RAM. The data is output for display on the background other than the display window spaces.

Next, flow condition pattern preparation methods will be discussed.

1. A slot machine comprising conventional mechanical rotating drums is rotated and the drums are shot with an optical camera at the shutter ring of the frame span time (shutter speed of 1/60 sec). At this time, auxiliary light such as a strobe is not used and a stable light source such as natural light or an incandescent lamp is used. Of course, the image is picked up in such a form that the camera moves up and down, as shown in FIG. 19. This image is read through a scanner, etc., and is converted into digital data for making a flow condition pattern.

2. A slot machine comprising conventional mechanical rotating drums is rotated and the drums are shot with a video camera as in 1. The image signal is read for making a flow condition pattern.

3. Computer graphics (CG) software is used to prepare a flow condition pattern in the following sequence:

a. Screen contrast (brightness) is lowered and set.

b. Read still picture is moved one dot at a time by a 1-frame movement distance and the data for each dot are added together.

c. Lastly, the contrast is balanced and symbol data of a flow condition pattern is set.

Figure 5:
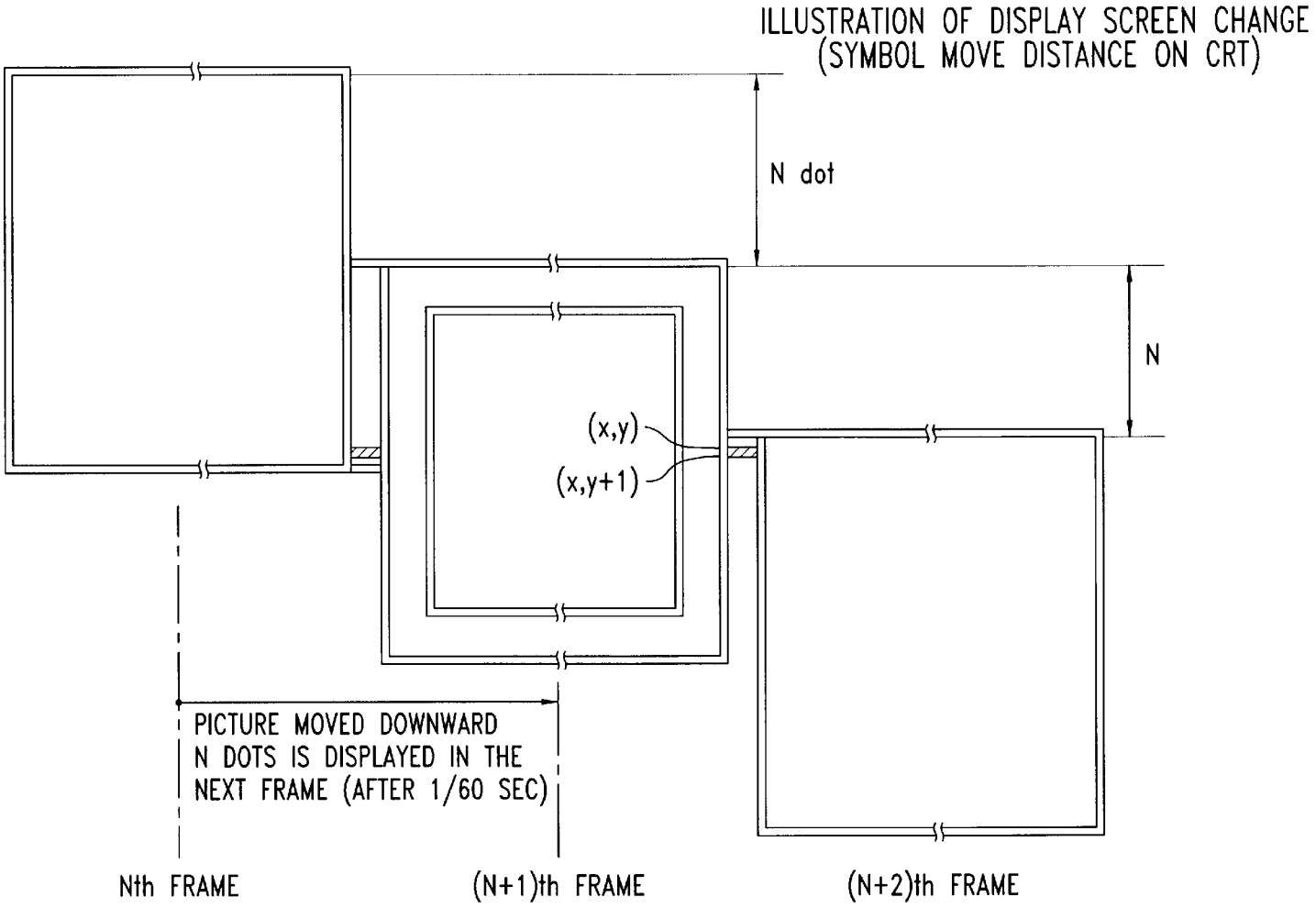
FIG. 5 is an illustration of display screen change.

FIG. 5 illustrates generally the display-screen sequence that simulates the rotation of symbols as if the symbols were actually imprinted on a rotating drum. When the slot machine simulates the rotation of such a drum at a constant speed, a symbol is displayed in a video frame as having moved N dots or pixels in the direction of rotation with respect to the previous frame.

Figure 6:
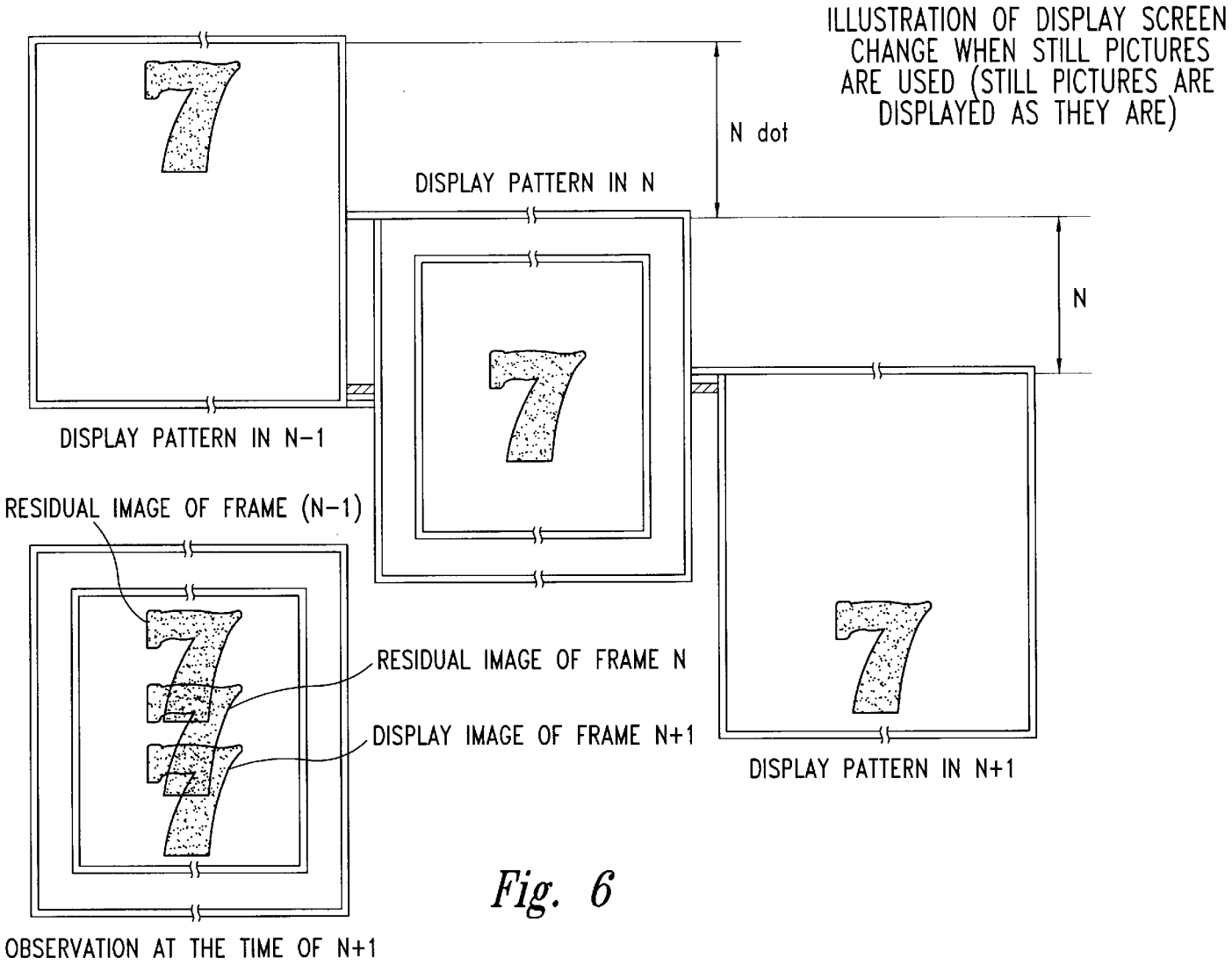
FIG. 6 is an illustration of display screen change when still pictures are used.
Figure 7:
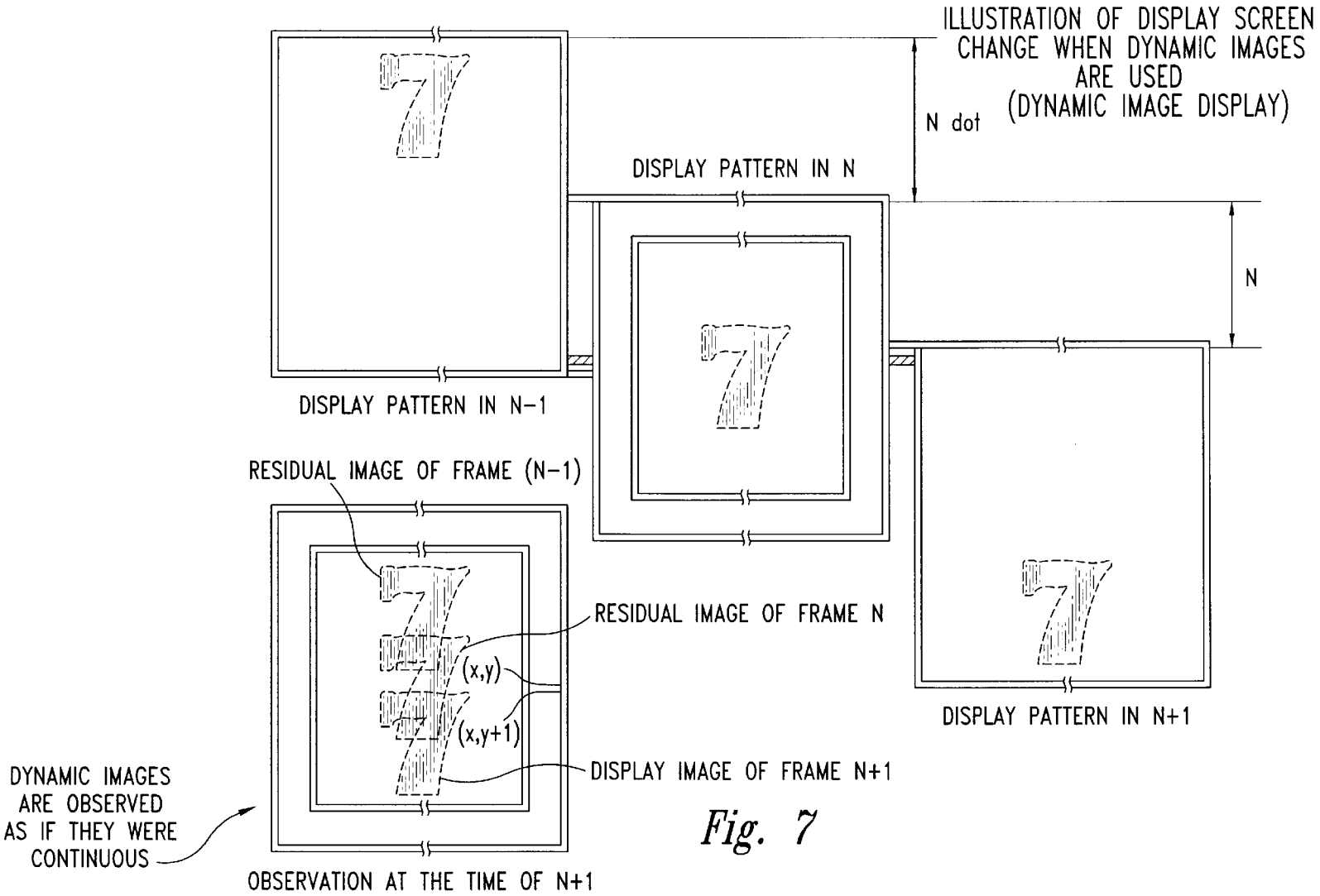
FIG. 7 is an illustration of display screen change when dynamic images are used.

The prepared flow condition pattern as described above is displayed on the display section as shown in FIG. 7, an illustration of display screen change when the flow condition pattern is used. FIG. 7 shows display patterns in frames (N−1), (N), and (N+1) and how the patterns are observed at the time of frame (N+1). The pattern in each frame is moved by N dots corresponding to the movement distance when a drum type slot machine is rotated for 1/60 or 1/30 sec. The pattern is observed as shown in FIG. 7 due to the residual image effect of the human eye at the time of frame (N+1). In the embodiment, still picture and flow condition patterns are stored in the CG-ROM and a read is changed from the still picture pattern to the flow condition pattern at a predetermined time. When a stop instruction is given, a read can be changed from the flow condition pattern to the still picture pattern at a predetermined time. For comparison, FIG. 6 provides an illustration of display screen change when still pictures are used. FIG. 6 shows display patterns in frames (N−1), (N), and (N+1) and how the patterns are observed at the time of frame (N+1).

When the flow condition pattern is used, the player can see the pattern as shown in "OBSERVATION AT THE TIME OF FRAME N+1" in FIG. 7 as if it were rotated on the mechanical drum of a slot machine.

Symbols moving at the frame period speed of 1/60 or 1/30 sec rather than still pictures, are provided and displayed as flow condition pattern symbols, whereby each picture is seen as it flows, thus the clearness of each picture is lost and the player can feel as if the entire drum is rotated. Although unclear display is made on the seemingly flowing screen, what each picture is can be roughly determined, thus the condition is satisfactory to experienced customers utilizing hand to eye coordination.

By moving the symbol pattern display position, the player can feel as if actual rotation were made as compared with conventional slot machines changing symbol patterns to the same position on the display screen.

As described above, by changing the movement distance, the rotation speed rises gradually for a short time, and the rotation speed soon becomes constant. When the stop switch is pressed, the rotation speed gradually slows down and the drum soon stops. This rotation pattern provides a more realistic motion, resembling the drum rotation of a mechanical slot machine.

The slot machine according to the invention enables the player to feel as if the drum has rotated, and thus it can provide dynamic and diversified interest for the players, as a slot machines using drums.

Figure 27A:
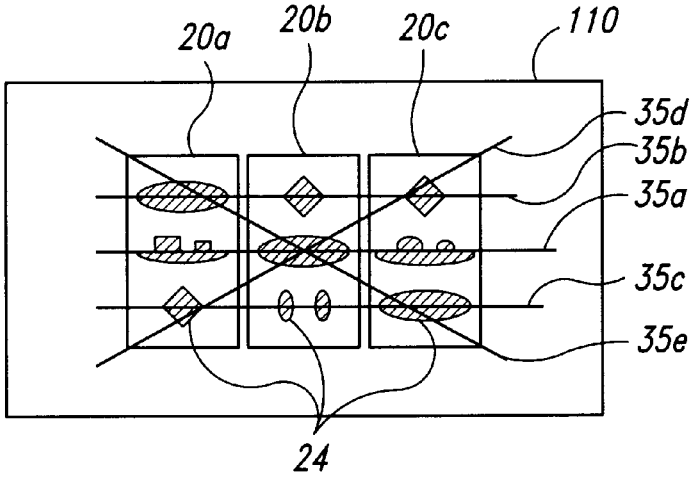
FIG. 27 is a symbol and line display illustration.
Figure 27B:
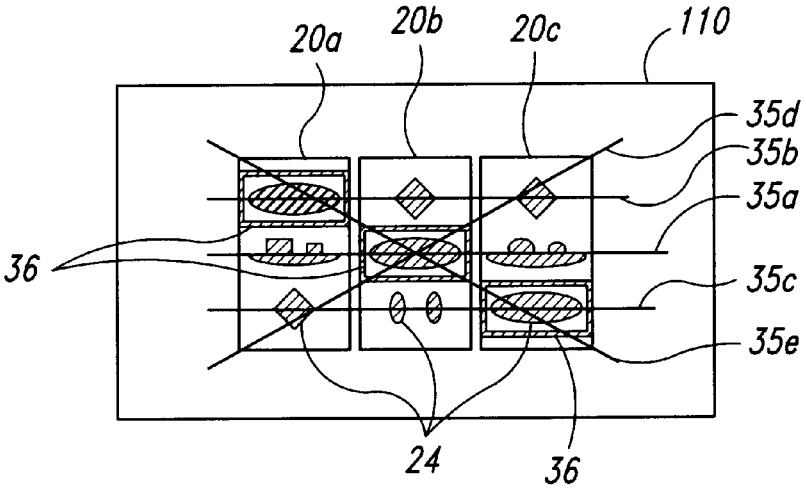

Next, an embodiment for displaying lines will be discussed. FIGS. 26 and 27 show display examples for displaying lines, wherein numerals 20*a*, 20*b*, and 20*c* denote display windows displayed on the display section 110. (B) shows an example in which a line is displayed on a horizontal row at the intermediate stage. (C) shows an example in which lines are displayed on three horizontal rows at the upper, intermediate, and lower stages. (D) shows an example in which lines are displayed on three horizontal rows at the upper, intermediate, and lower stages and on diagonal rows. Since the number of combinations of winning game play combinations varies depending on the number of input game play media or the bet rate, lines for the winning game play combinations are displayed. For example, when one game play medium is input, a line on the horizontal row at the intermediate stage is displayed as a betting line indicating that the win combination is a combination of predetermined symbols completed on the horizontal row at the intermediate stage of three symbols. Likewise, betting lines are displayed, as shown in FIG. 26, in response to the number of input game play media or the bet rate. In the embodiment, input game play media selection switches can be provided for each betting line as bet rate buttons. For example, to bet on the horizontal row at the intermediate stage as shown in FIG. 26 (B), one of the switches is used as a button switch for bet rate button 1. To bet on the three horizontal rows at the upper, intermediate, and lower stages as shown in FIG. 26 (C), another switch is used as a button switch of bet rate button 2. To bet on the three horizontal rows at the upper, intermediate, and lower stages and on a diagonal row, as shown in FIG. 26 (D), another switch is used as a button switch for bet rate button 3. If one bet rate button is provided, the betting lines are changed each time the button is pressed. When predetermined symbols are complete on the betting line, the line is displayed as a win. As win display, the line display color may be changed or the displayed symbols may be surrounded by a frame as shown in FIG. 27. Also, characters "WIN" may be displayed in the background portion. Win display can be previously defined in V-RAM. Further, when a player loses a game, the loss may also be displayed.

Next, the hardware configuration for display as shown in FIG. 26 will be discussed with reference to FIG. 23, a hardware block diagram for line display and win display.

As shown in FIG. 9, V-RAM 905 is background storage means for storing background pictures other than symbol display in the display window portions. The embodiment has different backgrounds. Backgrounds for line display, etc., as shown in FIG. 26 are provided as the different backgrounds. In this case, V-RAM may be provided for each background or divided into regions for use. In FIG. 23, V-RAM 3 is provided for the betting lines. The V-RAM 3, which is win combination storage means for betting line and win display, previously stores betting line displays and win displays, corresponding to the bet rates, shown on the display screen. V-RAM 1 is background storage means for storing background data other than the betting line and win displays. V-RAM 2 is symbol storage means for storing display window symbols and may be made of ROM as described above. Output of the symbol storage means, background storage means, and win combination storage means is controlled by display control means.

The data stored in the V-RAM 3 has all frame data shown on the display screen; betting line and win displays are stored as high data and others as low data. In the low data portion, output from other V-RAMs takes precedence. Thus, a video signal output from each V-RAM can be switched according to the data itself stored in the V-RAM 3. In the circuit shown in FIG. 23, the data stored in the V-RAM 3 is displayed taking top priority. The V-RAM 1 stores normal background data and low data is stored in a symbol display area.

Figure 23:
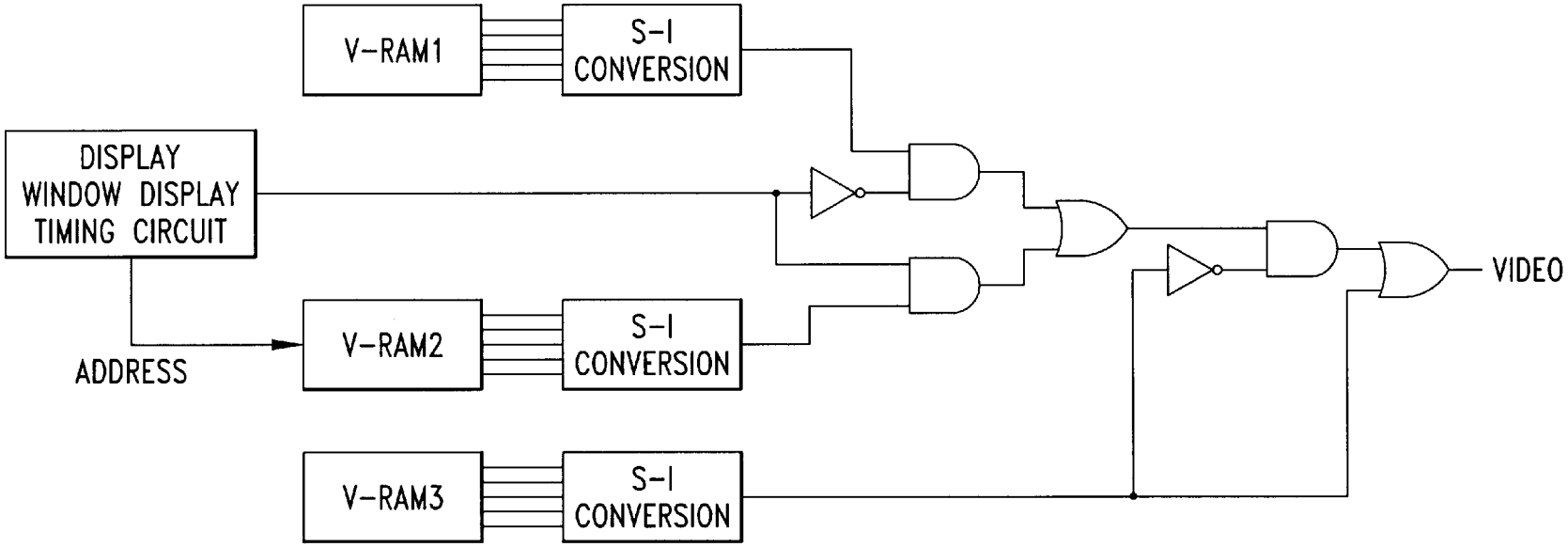
FIG. 23 is a block diagram of a betting line and win display hardware.

In FIG. 23, symbol data in the V-RAM 2 is read taking precedence over the background data in the V-RAM 1 as instructed from a display window display timing circuit of display control means. The V-RAM 2 is read when an address is specified from the display control unit, as described above. Thus, when it is specified, the V-RAM 2 is read taking precedence over the V-RAM 1. The V-RAM 1 is read out at any time as specified from a sequential counter (not shown). Corresponding to the identification numbers of betting line and win displays, corresponding to the bet rates, stored in the V-RAM 3, their top addresses are stored in a betting line table previously provided. To read the V-RAM 3, the betting line table is specified based on the identification number of the betting line so as to show betting line or win display from the game control unit, and the top address corresponding to the identification number is read. A predetermined V-RAM 3 area is read starting at the top address, and the corresponding betting line or win display is shown.

Figure 22:
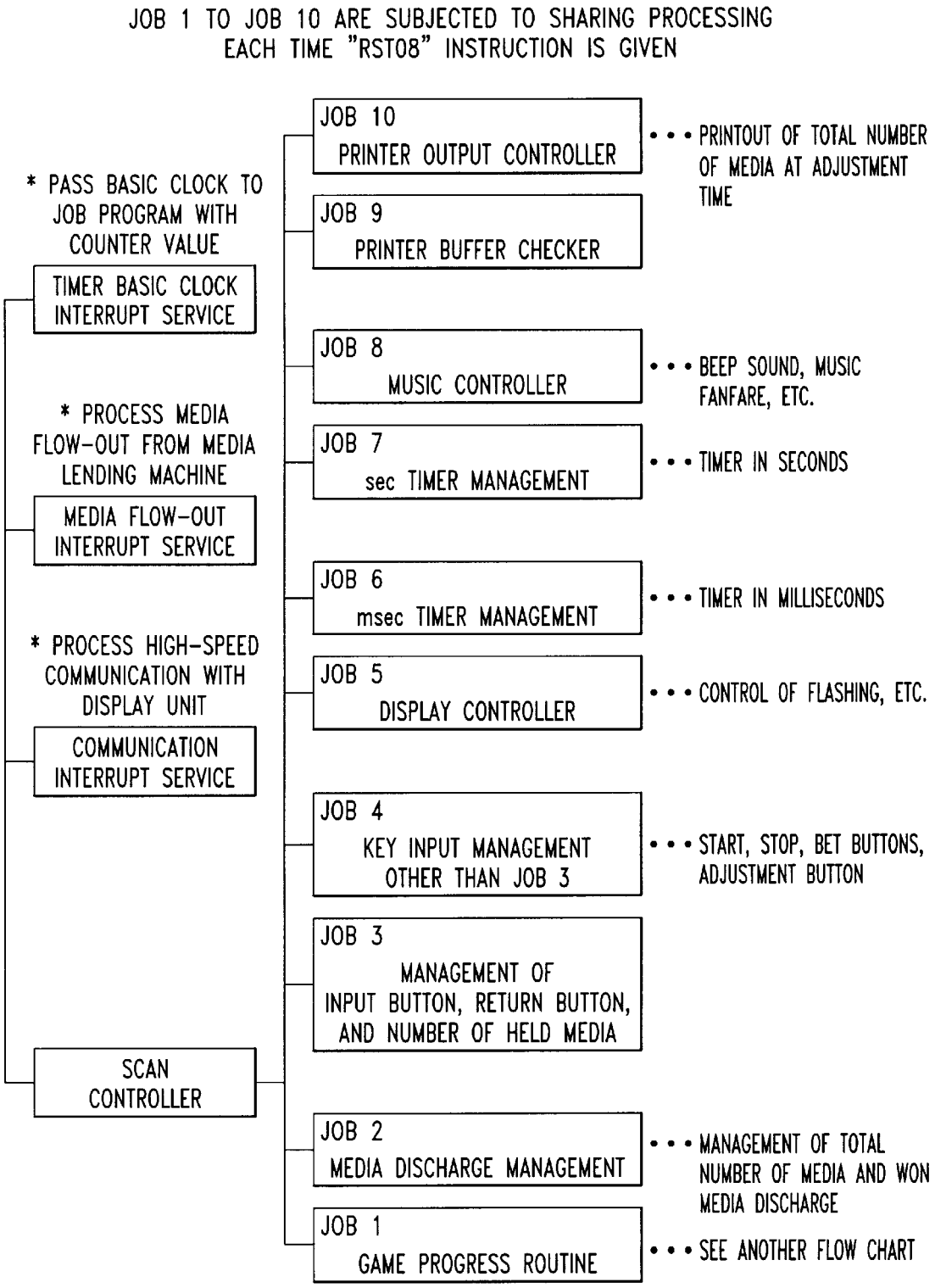
FIG. 22 is an illustration of job processing assignment.

Next, processing of the game control unit will be discussed. FIG. 22 is an illustration of game control unit processing assignment.

In FIG. 22, game control unit processing is mainly divided into timer basic clock interrupt service, media flow-out interrupt service, communication interrupt service, and scan controller for processing a plurality of jobs apparently in parallel. The scan controller is execution control means for controlling execution of jobs; a plurality of processing means are defined as jobs under the control of the scan controller. The game control unit comprises a CPU and a processing procedure is predetermined for each job. The programs indicating the processing procedures are preset in storage means such as ROM. Whenever an interrupt occurs, its interrupt service is executed. To assign jobs in the scan controller, event-driven type processing is performed for starting another job when a scan controller start instruction occurs while processing of each job is being performed. The scan controller comprises a scan register, which stores, for each job, a job condition code (containing a job identification code, registration end flag and start flag), a jump code (instruction jumping to the processing start address of the job), and a break address (indicating the start address at the next scan time; the top address at initialization time). The registration end flag is set to ON in the last condition code. The start flag uses one bit of the job condition code; it is set when processing of the corresponding job is to be performed, and is reset upon completion of the processing. When a start instruction occurs, the scan controller starts the jobs in the order stored in the scan register. When one job is started and processed in accordance with the processing flow of the job and "RST08 (restart address 08)" of a scan controller start instruction is executed, control is transferred to scan controller processing. If the start flag of the next job is ON in accordance with a predetermined transition order, control is transferred to the job. The start flag is set when the other job is being processed. When RST08 is executed, the execution address of the broken job at the time is stored in the break address in the scan register for executing processing starting at the continuation of the job at the next scan time. For example, when processing of job 1 is executed and a scan controller start instruction is executed, the scan controller transfers control to processing of job 2. If the start flag of job 2 is set, processing of job 2 is started; if not, control is transferred to the next job. After the scan controller transfers control to the last job, a return is made to job 1 and processing of job 1 is restarted at the address stored in the break address in the scan register for job 1. If the start flag of one job is not set, immediately control is transferred to the next job. Therefore, control can be transferred from processing of one job to another in only a short scanning time, so that the time is not wasted.

Game control unit processing during game progress will be discussed with reference to FIGS. 20 and 21. Also, a specific exampleof the event-driven type processing will be discussed. FIGS. 20 and 21 are gaming flowcharts of job 1 in the game control unit; FIG. 20 is a flowchart from turning on the slot machine power and starting a game to pressing the stop switch and FIG. 21 is a flowchart from pressing the stop switch to paying out media for a winning game play.

When the slot machine power is turned on in job 1 processing shown in FIG. 20, the slot machine enters a wait state until a player operates the start lever for starting a slot machine game. Thus, "RST08(restart address 08)" is executed and the current execution address is stored in the break address, then control is transferred to the next job (job 2).

Upon completion of scanning and processing of jobs, control is returned to job 1 processing and whether or not the start button is set to ON is determined. If the start button is not set to ON, whether or not one of the bet rate buttons is pressed is determined. If no bet rate buttons are pressed, "RST08 (restart address 08)" is executed, as described above, and control is transferred to the next job. If the start button is set to ON, whether or not media are held corresponding to the bet rate button is determined. If the media are held, the bet rate button lamp and lamps provided on the display means are turned on, the line corresponding to the bet rate are displayed, the start flag of the display controller of job 5 is set for instructing the display control unit, and the start flag of the music controller of job 8 is set so as to produce a beep sound. If the number of held media is insufficient, to inform the player, the display control unit is instructed to display black and the start flag of the music controller of job 8 is set so as to produce a beep sound, then "RST08 (restart address 08)" is executed. Upon completion of setting the bet rate, a gaming flag is set to ON and the start flag of the music controller of job 8 is set for instructing the music controller to start music. The number of bet media corresponding to each bet rate is subtracted from the number of held media and the display control unit is instructed to display display window rotation, then "RST08 (restart address 08)" is executed. When all display windows enter a constant speed display state, the display window stop button lamp is turned on.

Next, in FIG. 21, when the display window stop buttons are pressed, the display control unit is instructed to disable input gates of the to stop buttons and stop rotation display of the display windows. If the display windows are stopped in order after the lapse of a predetermined time without providing the stop buttons, a timer is started after the start button is turned ON, and the display windows are stopped in order after a lapse of the predetermined time. After the display windows are stopped, the symbols are stored. When all display windows are stopped, whether or not the current symbol combination matches a predetermined symbol combination is determined. When two of the three display windows are stopped, the music job may be instructed to change the number. Whether or not the symbol combination on each betting line matches a predetermined combination in accordance with the bet rate is determined. If the player wins the game, the display control unit is instructed to show win display and the music job is instructed to output a win fanfare. If the player loses the game, the display control unit is also instructed to show loss display and the music job is also instructed to output a loss fanfare. The number of won media paid out to the player is calculated in accordance with the bet rate, and the number of won media is displayed. Then, the start flag of a media discharge management job is set to ON and the media discharge management job performs media discharge processing.

Thus, the jobs are processed by the game control unit and game progress can be controlled.

Figure 24:
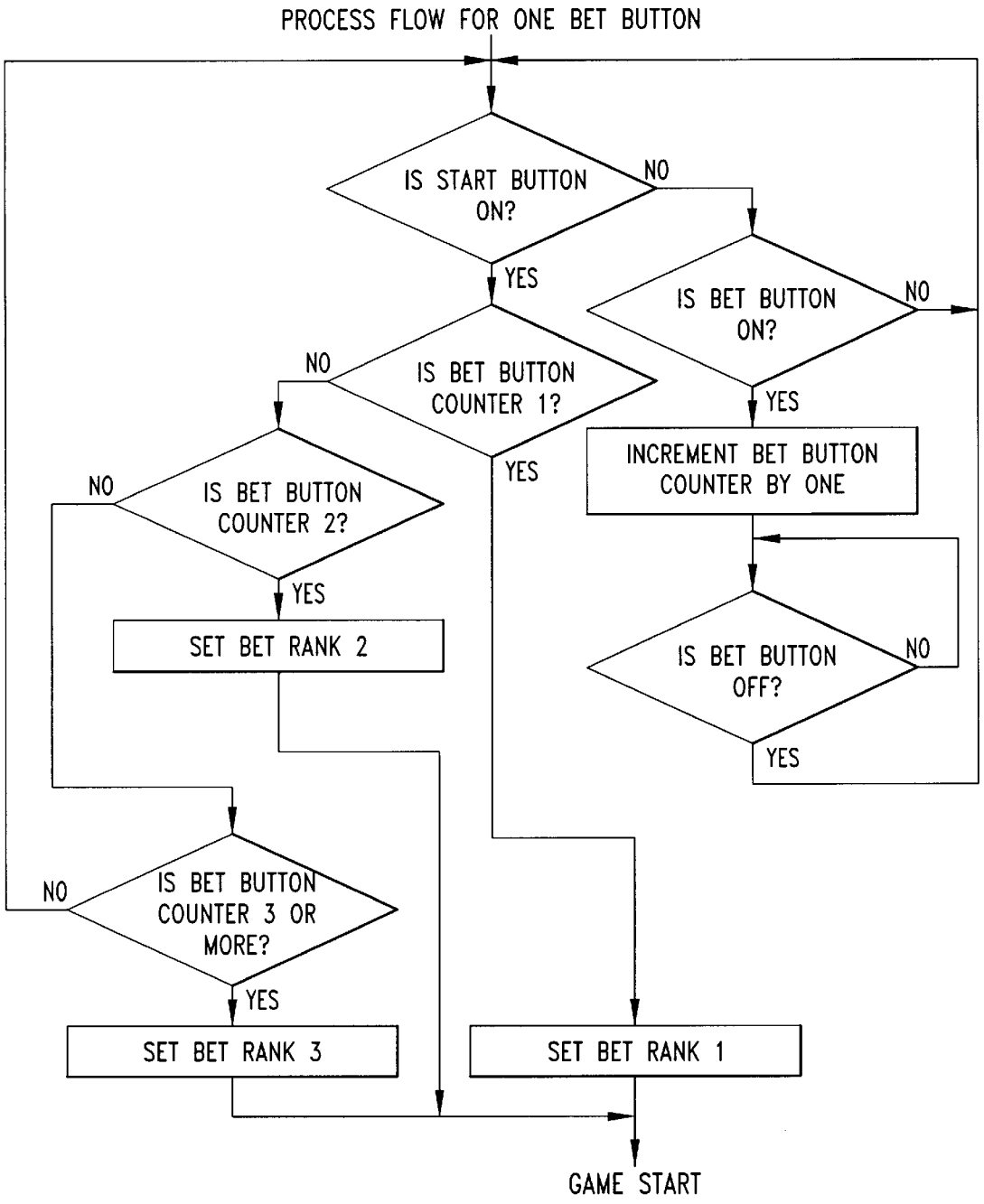
FIG. 24 is a flowchart for one BET button.
Figure 25A:
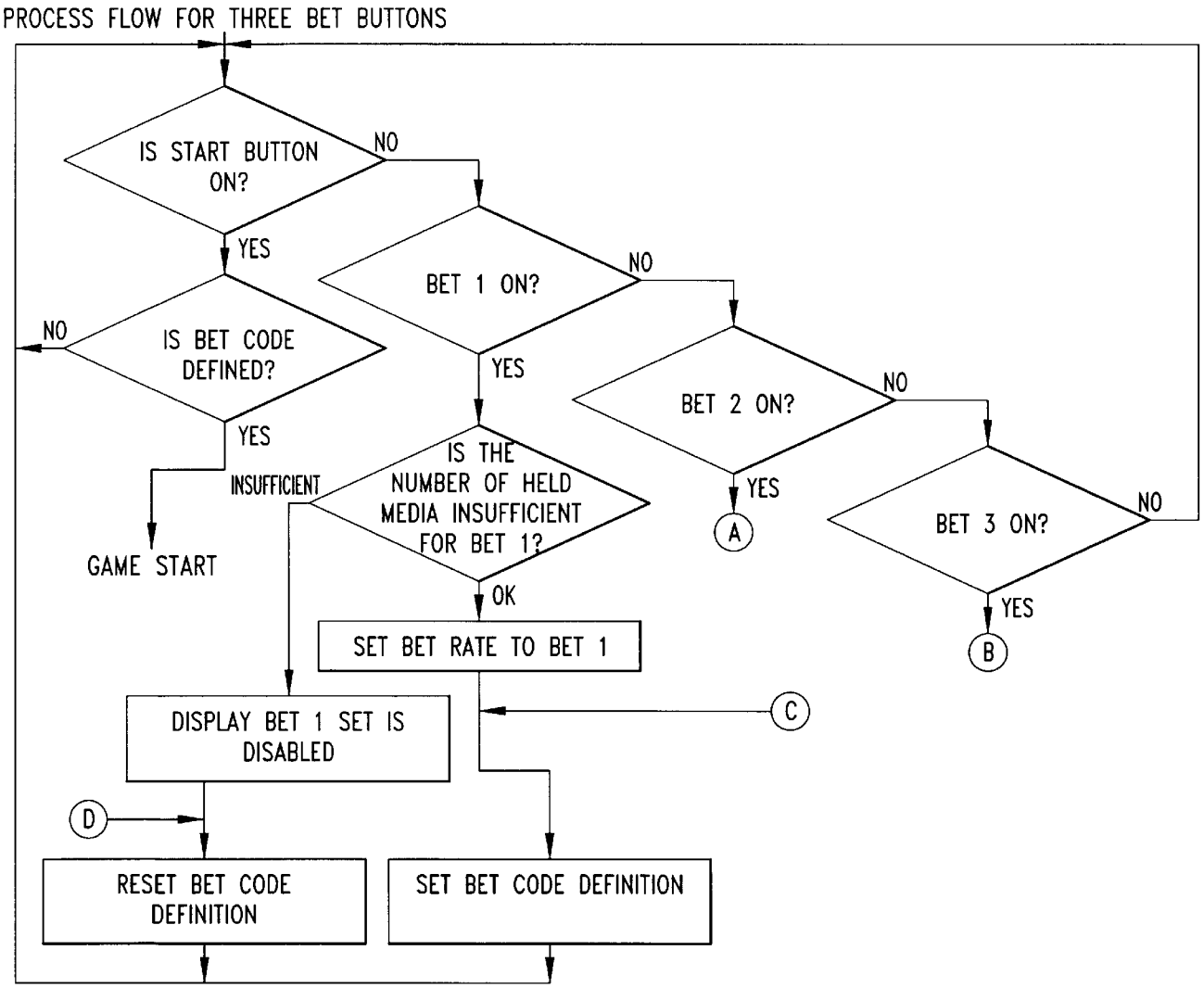
FIG. 25 is a flowchart for three BET buttons.
Figure 25B:
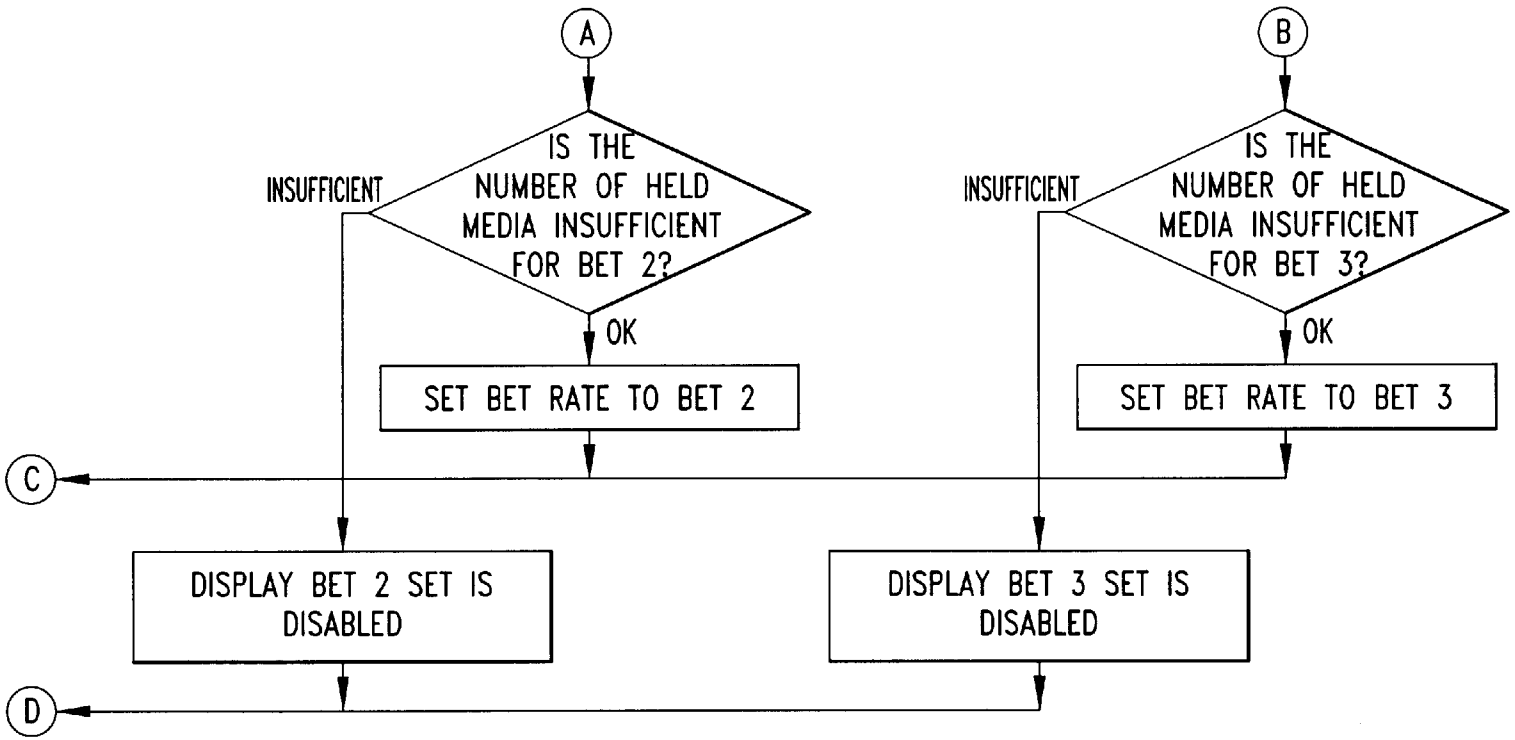
Figure 26A:
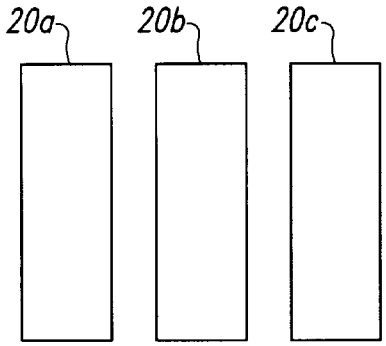
FIG. 26 is a line display illustration.
Figure 26B:
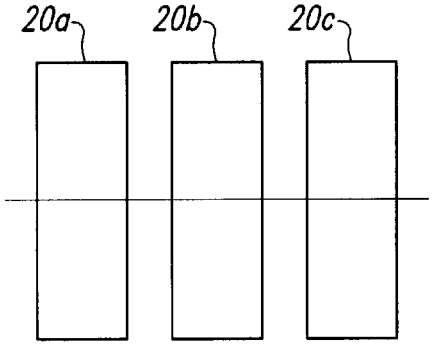
Figure 26C:
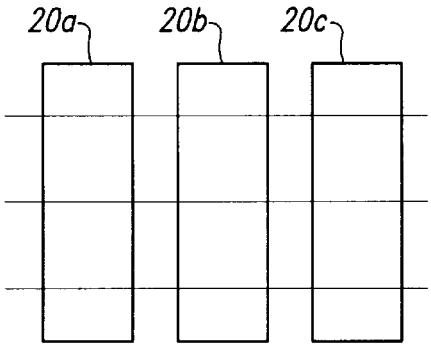
Figure 26D:
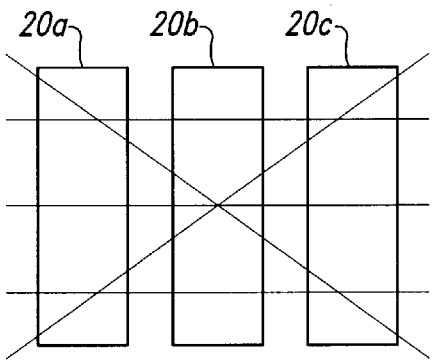

FIGS. 24 and 25 show process flows for one bet rate button and three bet rate buttons. The flow shown in FIG. 25 is the same as the process flow shown in FIG. 20; three bet rate buttons are provided and betting lines are set corresponding to the buttons. In the process flow for one bet rate button shown in FIG. 24, the number of times the bet rate button has been pressed is counted by a counter and betting lines are set corresponding to the number of times the button has been pressed. For example, to bet one horizontal row at the intermediate stage as shown in FIG. 26 (B), the bet rate button is pressed once; to bet three horizontal rows at the upper, intermediate, and lower stages as shown in FIG. 26 (C), the bet rate button is pressed twice; and to bet three horizontal rows at the upper, intermediate, and lower stages and a slant row as shown in FIG. 26 (D), the bet rate button is pressed three times. When the buttons are pressed four times, a return is made to betting one horizontal row at the intermediate stage as shown in FIG. 26 (B). In FIG. 24, the bet rate is set in response to the count of the counter counting the number of times the bet rate button has been pressed. The subsequent processing is similar to the processing shown in FIGS. 20 and 21.

According to the embodiment, apparently parallel processing is performed, so that independent control flows can be set as independent jobs. The wait time in each process is used to transfer control to another job and unexecuted process portions are skipped so as not to waste time.

Line display and win/loss display are stored in storage means such as V-RAM and the game control unit instructs the display control unit to draw the displays in response to the game progress condition. The circuit configuration in which an output from the V-RAM storing line display and win/loss display takes top priority is adopted, whereby background, display window symbols, and line and win/loss displays can be drawn by simple configuration.

Further, the buttons provided for each bet rate enable the player to set the bet rate more easily.

FIELD OF INDUSTRIAL APPLICATION

When background display and move display are executed on devices comprising a graphic display unit such as a CRT, LCD, or plasma display as well as slot machines, the invention enables display by performing display control with storage means provided for the background and moving displays.

What is claimed is:

1. A slot machine having a continuous display provided on a plane, the display including three display windows, a display control means coupled to the display for controlling the display to display within each of the display windows one of a respective plurality of symbols during a still mode, and to display within each of the display windows the respective plurality of symbols during a simulated-rotation mode, and game control means coupled to the display for controlling game progress, the improvement comprising:

storage means coupled to the display control means for storing display data that correspond to the symbols;

background storage means coupled to the display control means for storing display data that correspond to a betting line that, when displayed on the display, shows a selected combination of symbol positions within the display windows, the selected combination of symbol positions including one symbol position from each of the display windows; and selection means for enabling the player to select, other than by inserting a game play media, at least one of the betting lines along which a winning combination of symbols may occur;

wherein said display control means controls the display to display one of the symbols in each display window and the at least one selected betting line on the display simultaneously such that at a location of the display where a portion of any symbol coincides with a portion of the betting line, the display control means gives precedence to the background storage means over the storage means such that at the location, the display displays the portion of the betting line instead of the portion of the symbol, the selected betting line being continuous and extending through all of the symbol positions of the selected combination of symbol positions; and the game control means further determines a win condition when a winning combination of symbols occupies the selected combination of symbol positions.

2. The screen display type slot machine as claimed in claim 1 wherein said game control means determines a win by determining whether or not, after a simulated rotation of said symbols, the symbol combination on the betting line matches a predetermined symbol combination, and wherein said background storage means further stores display information for at least one of an event where the symbol combination matches the predetermined symbol combination and an event where it does not match the predetermined symbol combination.

3. The slot machine as claimed in claim 1 wherein said selection means comprises selection control means for specifying a winning game play combination that the player selects from among a plurality of predetermined winning game combinations of symbol positions, and operation sections handled by the player for selecting a winning game play combination, said operation sections corresponding to said plurality of predetermined winning game play combinations.

4. The slot machine as claimed in claim 1 wherein said storage means further stores predetermined display information on at least one of an event where a win is determined and an event where a win is not determined.

5. The slot machine as claimed in claim 1 wherein the storage means comprises a ROM (read-only memory), and wherein the display control means is mounted on a circuit board, the ROM being removably placed on the circuit.

6. The slot machine as claimed in claim 1 wherein the background storage means comprises a VRAM (video random access memory).

7. The slot machine as claimed in claim 1 wherein the background storage means stores pixel data in a portion corresponding to the betting lines as valid data, and wherein the display control means superposes on the display an output data from the storage means and the background storage means; and on portions of the display where the valid data and the output data from the storage means coincide, the display control means displays only the valid data.

8. The slot machine of claim 1 wherein the display control means controls the background storage means to provide the display data corresponding to the betting line to the display screen during the simulated-rotation mode.

9. The slot machine of claim 1 wherein the display control means prohibits the display from displaying the betting line during one or more time periods.

10. The slot machine of claim 1, further comprising a control storage means for storing a program that is executed by the display control means.

11. The slot machine of claim 1 wherein said display control means controls said display screen such that at a second section of said display screen where a second portion of said displayed background is coincident with a second portion of said displayed symbol but is not coincident with said selected betting line, said display control means gives said second portion of said displayed symbol priority over said second portion of said displayed background such that at said second section, said display screen displays only said second portion of said displayed symbol.

12. A slot machine comprising display means having a continuous display screen provided on a plane facing a player, said display screen having three display windows, a display control means for controlling said display means such that said display windows each display one of a respective plurality of symbols in a still mode during a first time period, and each display said respective plurality of symbols in a simulated-rotation mode during a second time period, and game control means for controlling game progress, wherein the improvement comprises:

storage means for storing symbol display data that corresponds to a plurality of symbol patterns;

background storage means for storing line display data that corresponds to betting lines that the player selects to place a bet and that correspond to predetermined winning game-play combinations of symbol positions within the display windows, each of the winning combinations including one symbol position from each of said display windows;

said display control means issuing an output instruction to said storage means and to said background storage means in order to control said display means, said display control means giving priority to said background storage means over said storage means for portions of said display screen where both said symbol display data and said line display data are coincident;

selection means for enabling the player to select, other than by inserting a game play media, at least one of the betting lines along which a winning combination of symbols may occur;

said display control means for controlling said display screen to display said selected betting line such that said selected betting line is continuous and extends through all of the symbol positions of the selected winning combination of symbol positions;

display order storage means for defining a display order of said symbol patterns for display on each display window of said display means among said plurality of symbol patterns stored in said storage means and storing a start address of each of said plurality of symbol patterns stored in said storage means;

hold means for holding display data representing the current display state on said display means for each display window;

display position storage means for storing information on read start and end positions of said storage means for symbols that are displayed on each display window of said display means among said plurality of symbol patterns stored in said storage means in relation to game progress, wherein said display control means comprises address generation means for referencing said display order storage means according to the information representing the current display state held in said hold means in relation to the game progress, extracting a start address of a next symbol pattern based on the display order defined in said display order storage means, referencing said display position storage means for generating addresses from the display start position to the display end position based on the extracted start address for each symbol on the display screen of each display window, and giving the generated addresses to said storage means; and means for determining a win when a winning combination of symbols occupies said selected winning combination of symbol positions.

13. The slot machine as claimed in claim 12 wherein said display position storage means previously stores a symbol pattern read start position address of said storage means and the number of data bytes of the symbol pattern for display as the information on the read start and end positions of said storage means, and wherein said address generation means comprises:

data counters provided for said display windows, said data counters for loading the number of data bytes of the symbol pattern for display from said display position storage means and for counting the number of data bytes as said storage means is read; and address counters provided for said display windows, said address counters for obtaining the read top address of the symbol pattern in accordance with the display order and the symbol pattern start address stored in said display order storage means and the symbol pattern read start position address stored in said display position storage means and outputting symbol pattern read addresses as said storage means is read, said data and address counters loading next values after said data counter counts the number of data bytes.

14. The slot machine as claimed in claim 12 wherein said display control means reads the symbol patterns by switching outputs of said address counters provided for each display window in a time division manner.

15. The slot machine as claimed in claim 12 comprising a stop mode for updating the read symbol pattern at the same position on the display screen at display update, an acceleration mode for moving the read image by a movement distance to simulate the rotation of symbols within the display window and for acceleratively increasing a magnitude change of the movement distance, a constant speed mode for holding the movement distance constant, and a deceleration mode for decreasing the magnitude change of the movement distance, wherein said display position storage means has tables for storing the information on the read start and end positions of said storage means so as to move the symbol pattern display positions on said display means in order each time display is updated, said tables being provided for each of said modes, and wherein said display control means selects a table of said display position storage means for referencing in conformance with a selection of one of said modes.

16. A slot-type machine, comprising:

a continuous display screen that defines three display windows and that displays, within each of said display windows, one of a respective plurality of symbols in a still mode during a first time period and said respective plurality of symbols in a simulated-rotation mode during a second time period;

a game-progress controller;

a symbol storage circuit that stores display data that corresponds to said symbols;

a background storage circuit that stores display data that corresponds to betting lines that highlight respective winning combinations of symbol positions within said display windows during a portion of said first time period, said winning combinations each including one symbol position from each of said display windows;

a selector coupled to said game progress controller that enables a player to select, other than by inserting a game play media, at least one of the betting lines along which a winning combination of symbols may occur;

allows a player to select a pattern of at least one of the betting lines along which one of the winning combinations may occur;

a display controller that is coupled to said display screen, said game-progress controller, and said symbol and background storage circuits, said display controller for controlling said display screen such that during said portion of said first time period, said display screen simultaneously displays one of said symbols and said selected betting line such that at a location of said display screen where a portion of a symbol coincides with a portion of said selected betting line, said display controller gives priority to said background storage means over said symbol storage means such that at said location, said display screen displays said portion of said selected betting line instead of said portion of said symbol, said selected betting line being continuous and extending through each symbol position of the selected winning combination of symbol positions; and said game progress controller for determining a win when a winning combination of symbols occupies said selected winning combination of symbol positions.

17. The machine of claim 16 wherein said background storage circuit stores display data that corresponds to a win indicator; and after a simulated rotation of said symbols, if said display screen displays said winning combination of symbols in said winning combination of symbol positions, then said display controller controls said display screen to display said win indicator.

18. The machine of claim 16 wherein said background storage circuit stores display data that corresponds to a lose indicator; and after a simulated rotation of said symbols, if said display screen displays a losing combination of symbols in said winning combination of symbol positions, then said display controller controls said display screen to display said lose indicator.

19. The machine of claim 16 wherein said portion of said first time period equals a fraction of said first time period.

20. A slot machine having a continuous display provided on a plane, the display including three display windows, a display control means coupled to the display for controlling the display to display within each of the display windows one of a respective plurality of symbols and game control means coupled to the display for controlling game progress, the improvement comprising:

storage means coupled to the display control means for storing display data that correspond to the symbols;

background storage means coupled to the display control means for storing display data that correspond to a betting line that, when displayed on the display, shows a selected combination of symbol positions within the display windows, the selected combination of symbol positions including one symbol position from each of the display windows; and selection means for enabling the player to select, other than by inserting a game play media, at least one of the betting lines along with a winning combination of symbols may occur;

wherein said display control means controls the display to display one of the symbols in each display window and the at least one of selected betting line on the display.

21. The slot machine as claimed in claim 20 wherein the background storage means stores pixel data in a portion corresponding to the betting lines as valid data, and wherein the display control means superposes on the display an output data from the storage means and the background storage means; and on portions of the display where the valid data and the output data from the storage means coincide, the display control means displays only the valid data.

22. The slot machine of claim 20, further comprising a control storage means for storing a program that is executed by the display control means.

23. The slot machine as claimed in claim 20, wherein said display control means controls the display to display one of the symbols in each display window and the at least one selected betting line on the display, simultaneously such that at a location of the display where a portion of any symbol coincides with a portion of the betting line, the display control means gives precedence to the background storage means over the storage means such that at the location, the display displays the portion of the betting line instead of the portion of the symbol, the selected betting line being continuous and extending through all of the symbol positions of the selected combination of symbol positions; and the game control means further determines a win condition when a winning combination of symbols occupies the selected combination of symbol positions.

24. The slot machine of claim 23, wherein said display control means controls said display screen such that at a second section of said display screen where a second portion of said displayed background is coincident with a second portion of said displayed symbol but is not coincident with said selected betting line, said display control means gives said second portion of said displayed symbol priority over said second portion of said displayed background such that at said second section, said display screen displays only said second portion of said displayed symbol.

* * * * *